US010443864B2

(12) United States Patent
Yun et al.

(10) Patent No.: US 10,443,864 B2
(45) Date of Patent: Oct. 15, 2019

(54) AIR CONDITIONER

(71) Applicant: Samsung Electronics Co., Ltd., Suwon-si, Gyeonggi-do (KR)

(72) Inventors: Yeon Seob Yun, Suwon-si (KR); Sung Jae Kim, Seongnam-si (KR); Chang Sik Lee, Suwon-si (KR); Jong Whal Kim, Suwon-si (KR); Ji Hong Kim, Suwon-si (KR); Jin Gyun Kim, Seongnam-si (KR); Seung Won Oh, Seongnam-si (KR); Sang Ki Yoon, Suwon-si (KR); Won Hee Lee, Yongin-si (KR); Jae Rim Jung, Asan-si (KR); Seong Deok Cheon, Suwon-si (KR); Sung Hyun Chun, Suwon-si (KR); Jun Seok Kwon, Anyang-si (KR); Hyun Joo Jeon, Hwaseong-si (KR); Chang Woo Jung, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 15/745,088

(22) PCT Filed: Jul. 12, 2016

(86) PCT No.: PCT/KR2016/007565
§ 371 (c)(1),
(2) Date: Jan. 15, 2018

(87) PCT Pub. No.: WO2017/014477
PCT Pub. Date: Jan. 26, 2017

(65) Prior Publication Data

US 2018/0216835 A1 Aug. 2, 2018

(30) Foreign Application Priority Data

Jul. 17, 2015 (KR) ..... 10-2015-0101976
Feb. 15, 2016 (KR) ..... 10-2016-0016906

(51) Int. Cl.
*F24F 1/022* (2019.01)
*F24F 13/08* (2006.01)
(Continued)

(52) U.S. Cl.
CPC ..... *F24F 1/022* (2013.01); *F24F 1/005* (2019.02); *F24F 1/0007* (2013.01);
(Continued)

(58) Field of Classification Search
CPC ..... F24F 1/022; F24F 1/0014; F24F 1/0007; F24F 13/20; F24F 13/08; F24F 2001/004
See application file for complete search history.

(56) References Cited

U.S. PATENT DOCUMENTS 4,958,500 A * 9/1990 Kuroda ..... F24F 1/0033 62/263
2006/0037355 A1* 2/2006 Hwang ..... F24F 1/0007 62/428

(Continued)

FOREIGN PATENT DOCUMENTS

CN 1979024 A * 6/2007
JP 2012093043 A 5/2012

(Continued)

OTHER PUBLICATIONS

ISA/KR, "International Search Report and Written Opinion of the International Searching Authority," International Application No. PCT/KR2016-007565, dated Sep. 22, 2016, 12 pages.

*Primary Examiner* — Emmanuel E Duke

(57) ABSTRACT

An air conditioner according to the present disclosure includes a housing provided with an outer panel forming an (Continued)

appearance, and an opening formed in the outer panel; a heat exchanger configured to exchange heat with air introduced to the inside of the housing; a first discharge portion connected to the opening to discharge heat-exchanged air to the outside; a second discharge portion disposed in a lower side of the first discharge portion in the outer panel to discharge the heat-exchanged air; and a blowing fan disposed inside of the housing to move air, which is heat-exchanged by the heat exchanger, in a direction of the second discharge portion.

18 Claims, 20 Drawing Sheets

(51) Int. Cl.

| | |
|---|---|
| ***F24F 13/20*** | (2006.01) |
| ***F24F 1/0007*** | (2019.01) |
| ***F24F 1/0014*** | (2019.01) |
| ***F24F 1/005*** | (2019.01) |

(52) U.S. Cl.
CPC ..... *F24F 1/0014* (2013.01); *F24F 13/08* (2013.01); *F24F 13/20* (2013.01)

(56) References Cited

U.S. PATENT DOCUMENTS

| | | | | |
|---|---|---|---|---|
| 2006/0086138 | A1* | 4/2006 | Park | F24F 1/0007 62/428 |
| 2014/0097730 | A1* | 4/2014 | Kim | F24F 1/0014 312/236 |
| 2014/0238650 | A1* | 8/2014 | Yoon | F25B 43/006 165/177 |

FOREIGN PATENT DOCUMENTS

| | | | |
|---|---|---|---|
| KR | 10-2007-0060875 | A | 6/2007 |
| KR | 10-0726946 | B1 | 6/2007 |
| KR | 10-2014-0019207 | A | 2/2014 |
| KR | 10-2014-0037985 | A | 3/2014 |

* cited by examiner

【Fig. 1】
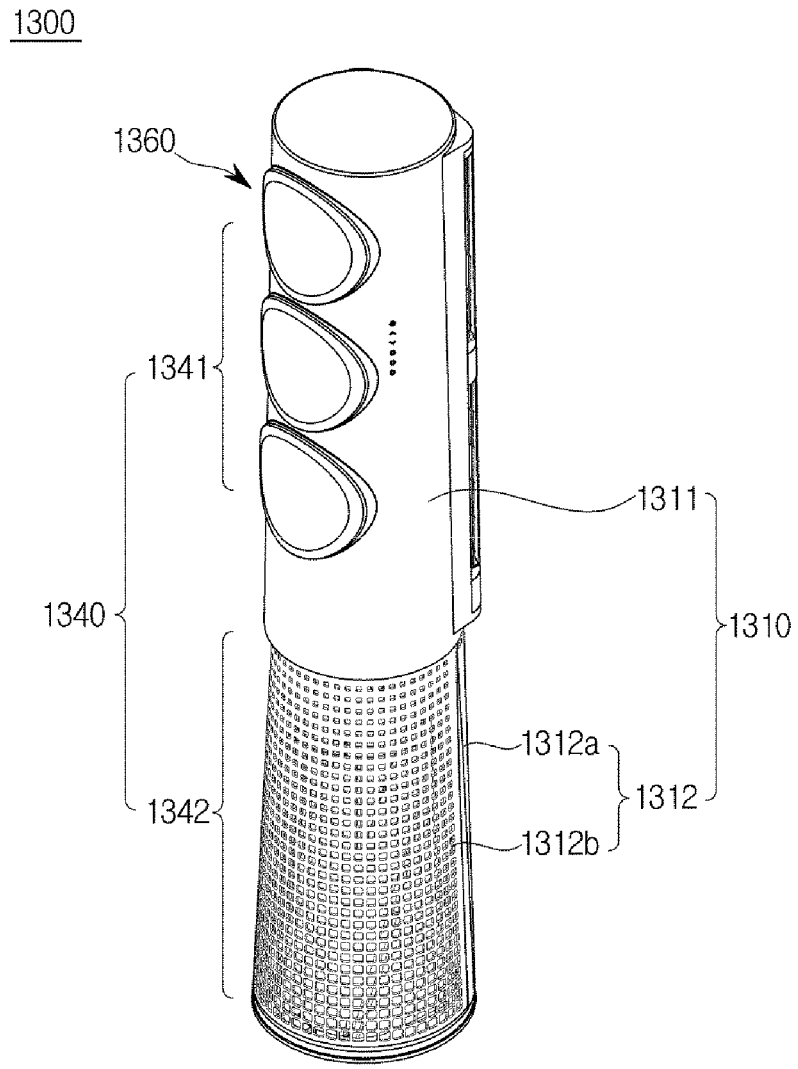

【Fig. 2】
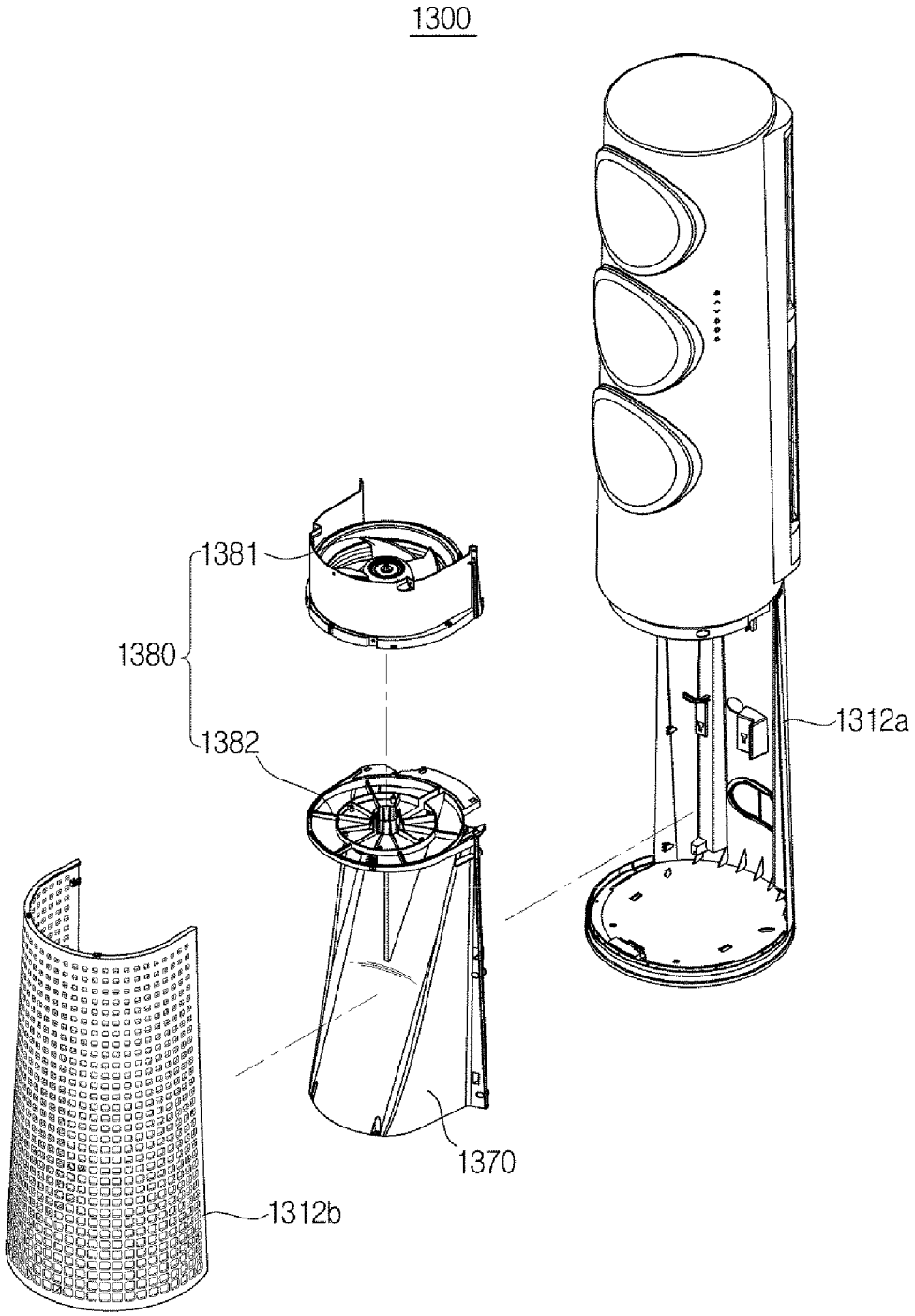

【Fig. 3】
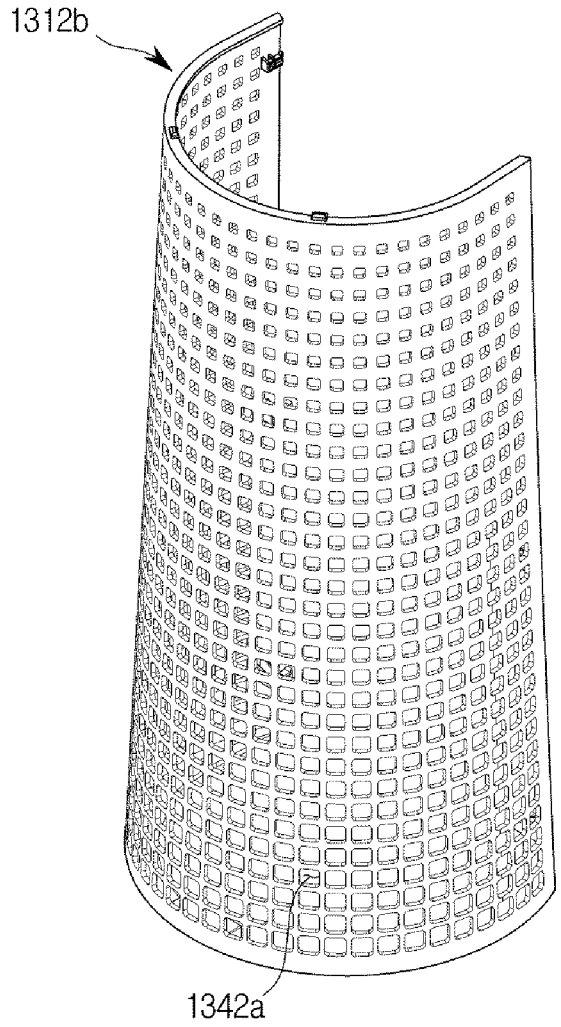

【Fig. 4】
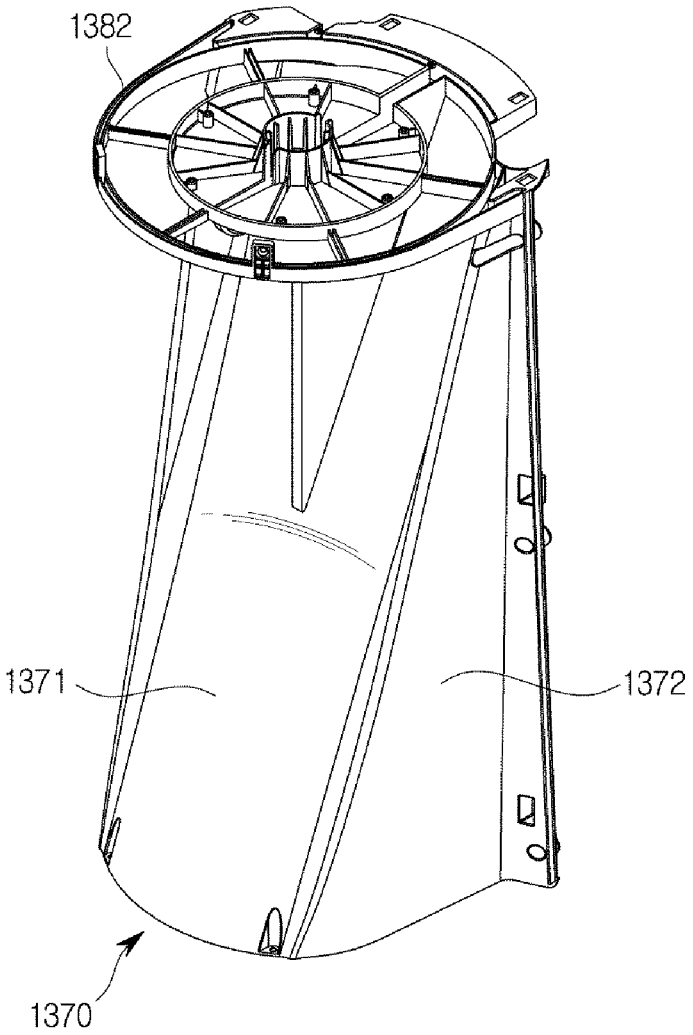

【Fig. 5】
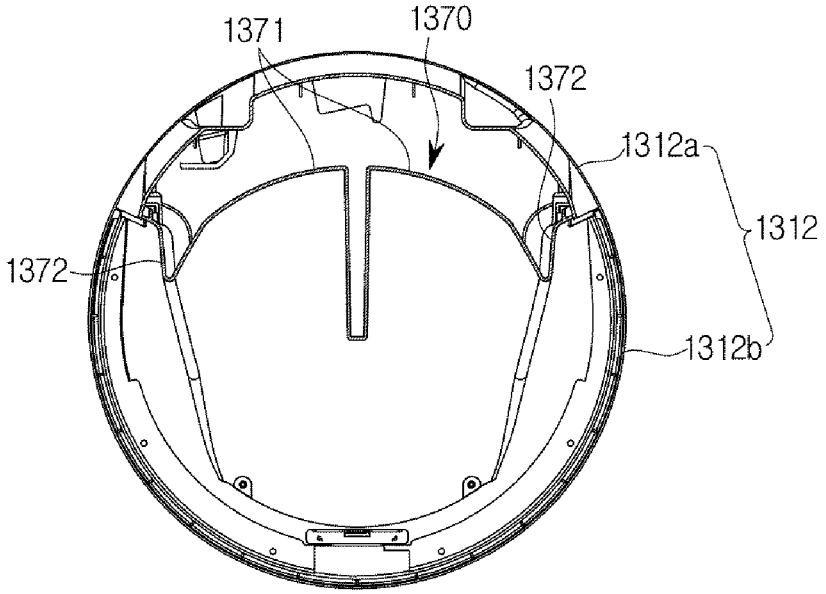

【Fig. 6】
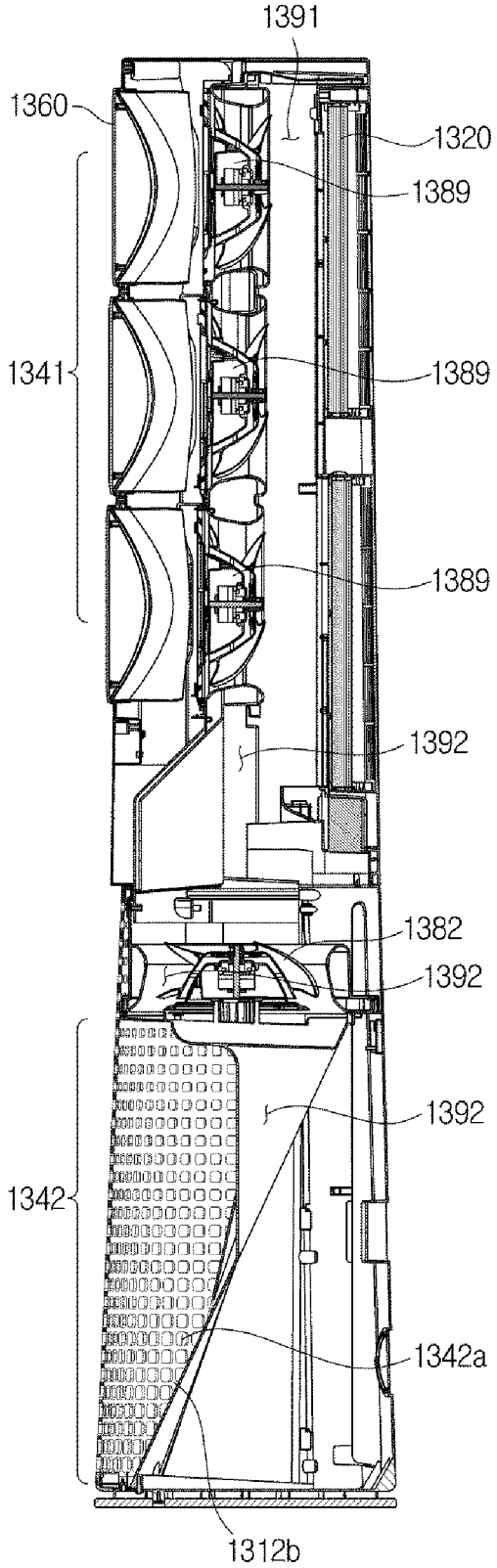

【Fig. 7】
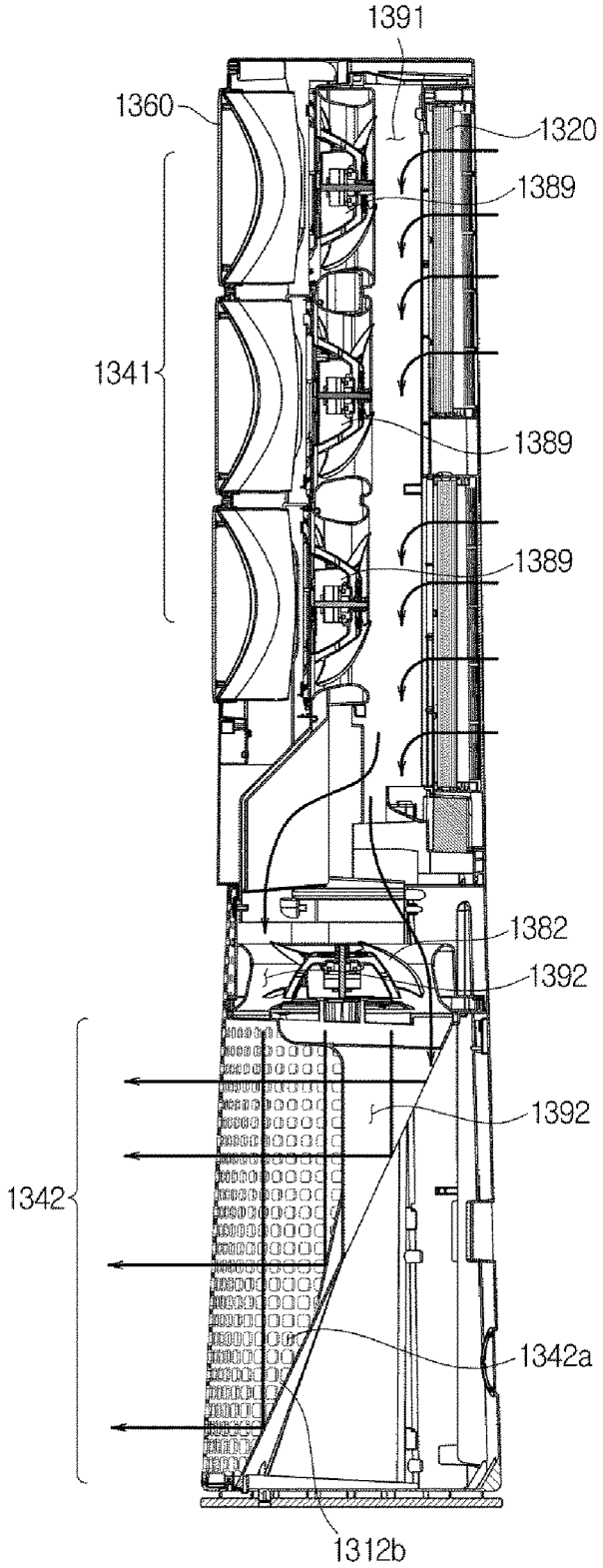

【Fig. 8】
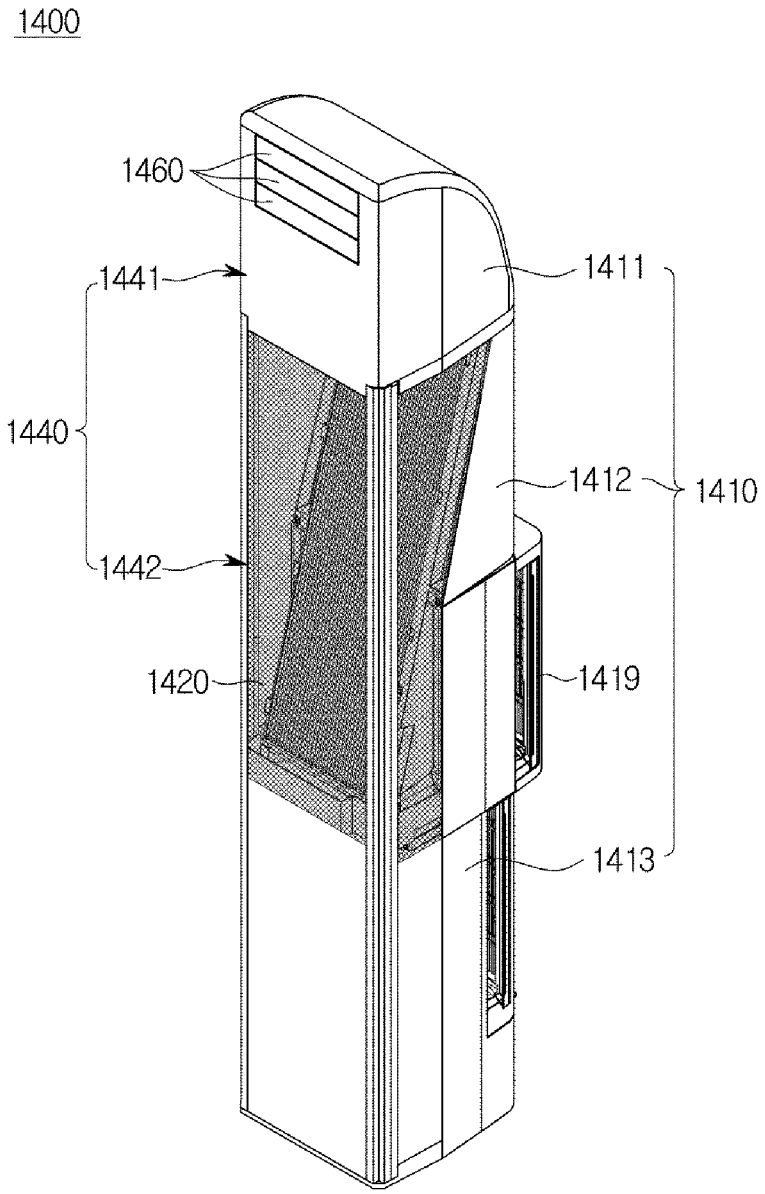

【Fig. 9】
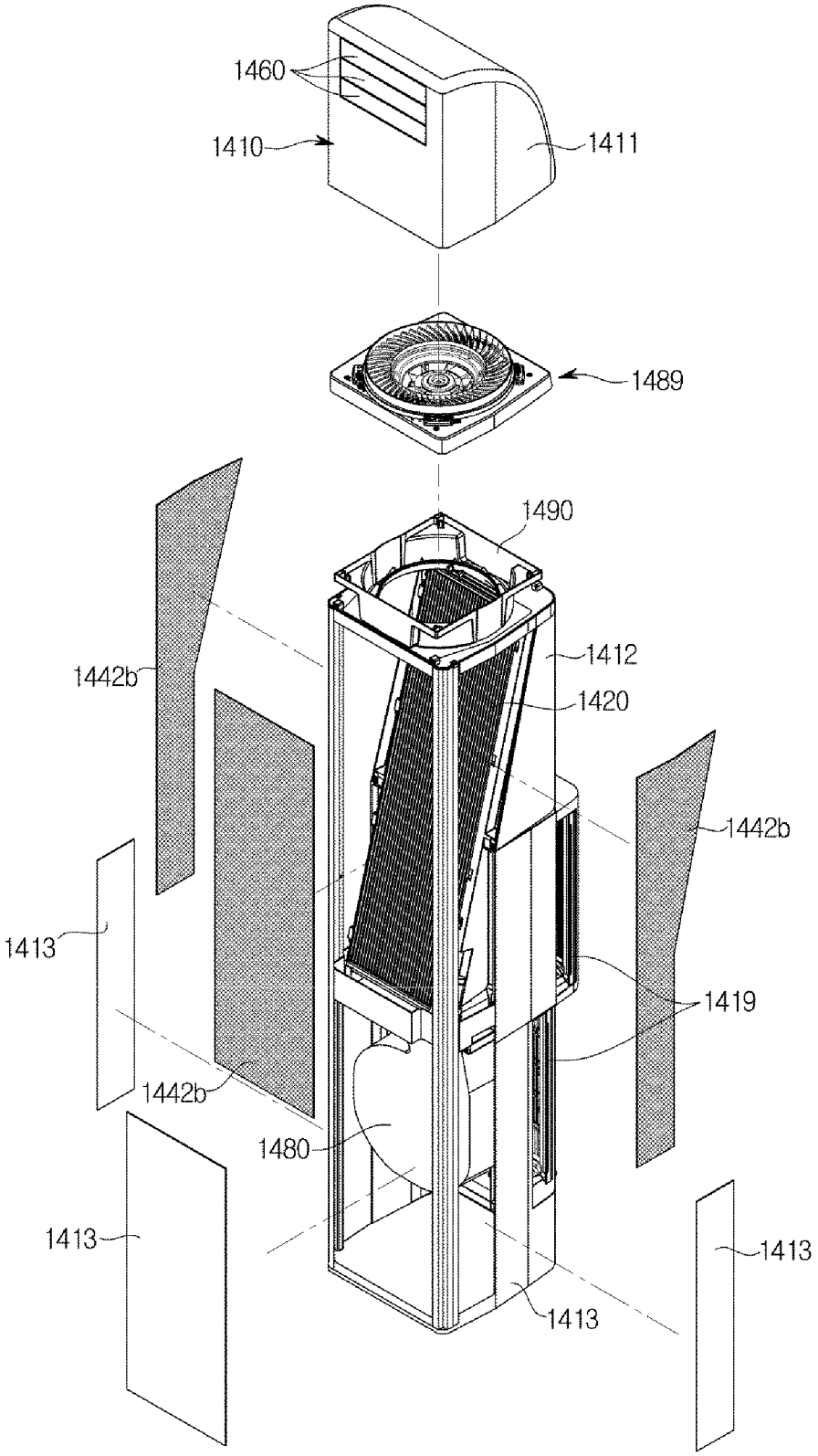

【Fig. 10】
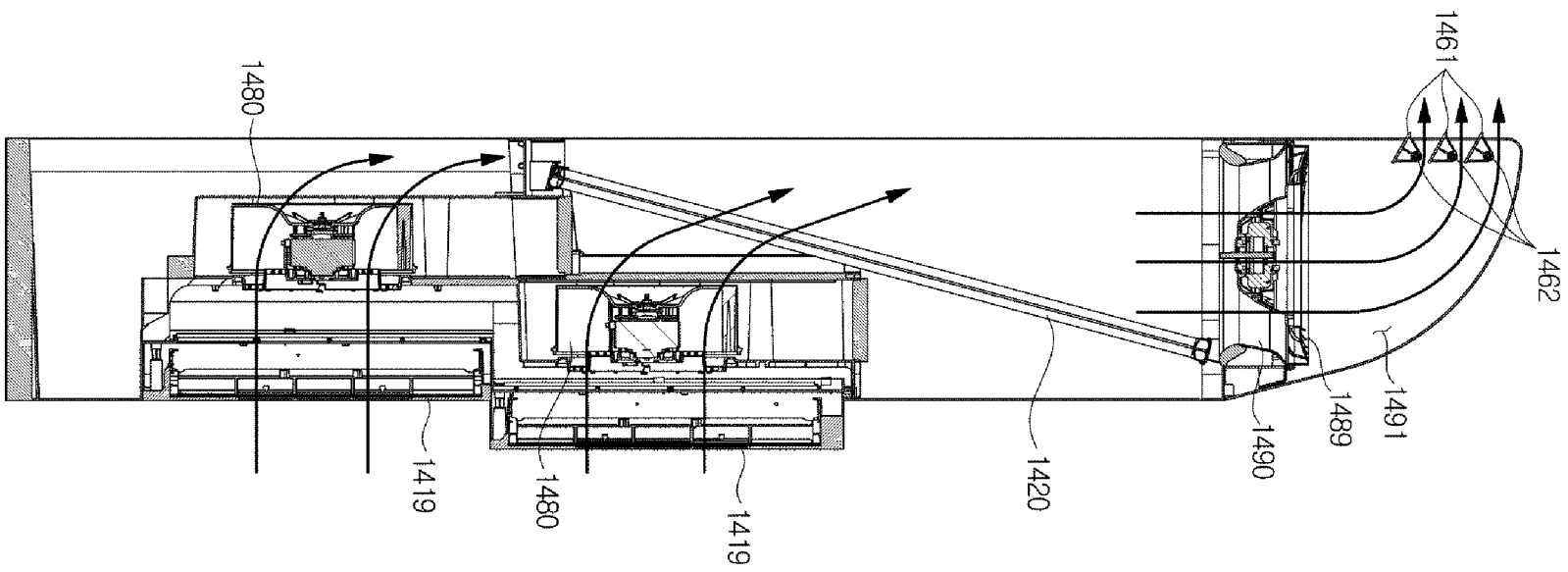

【Fig. 11】
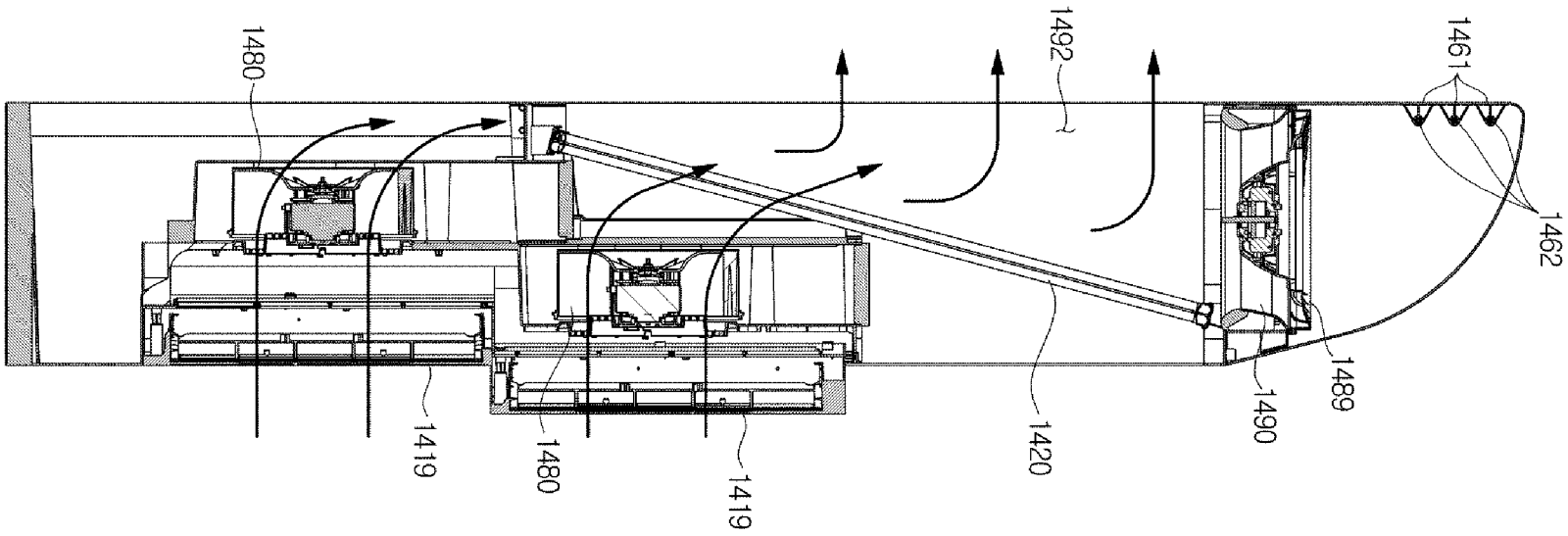

【Fig. 12】
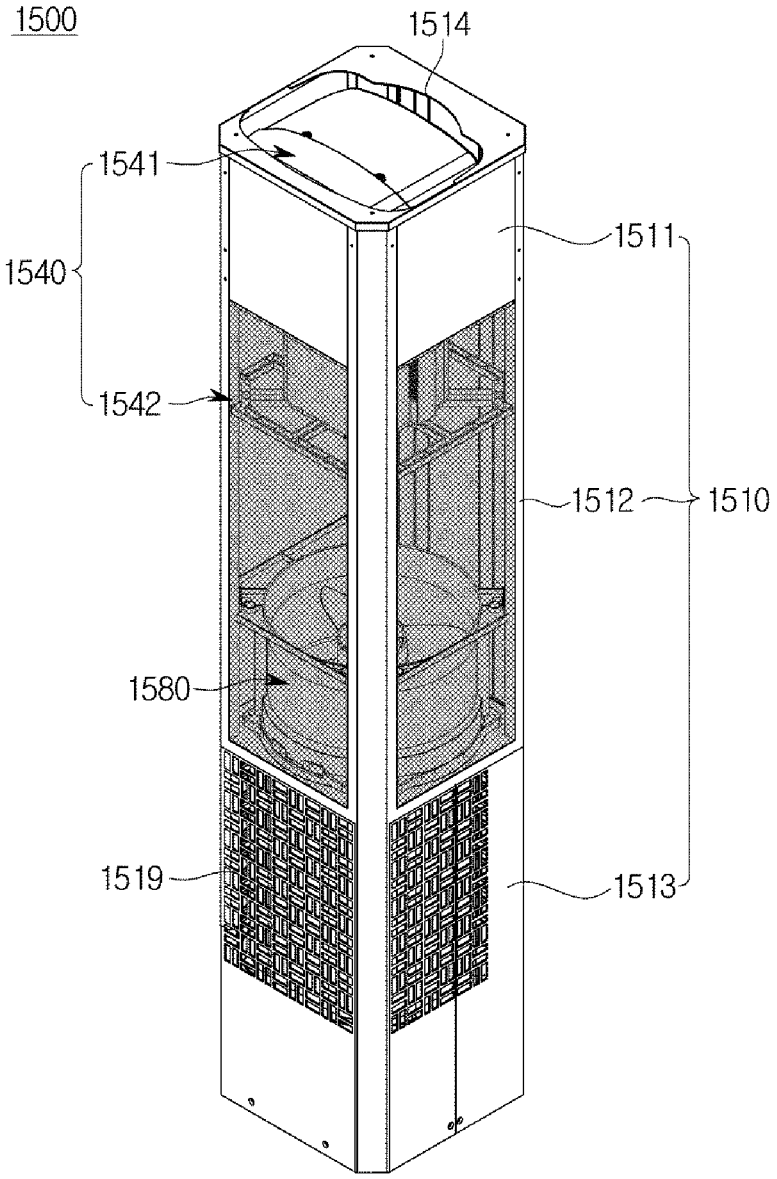

【Fig. 13】
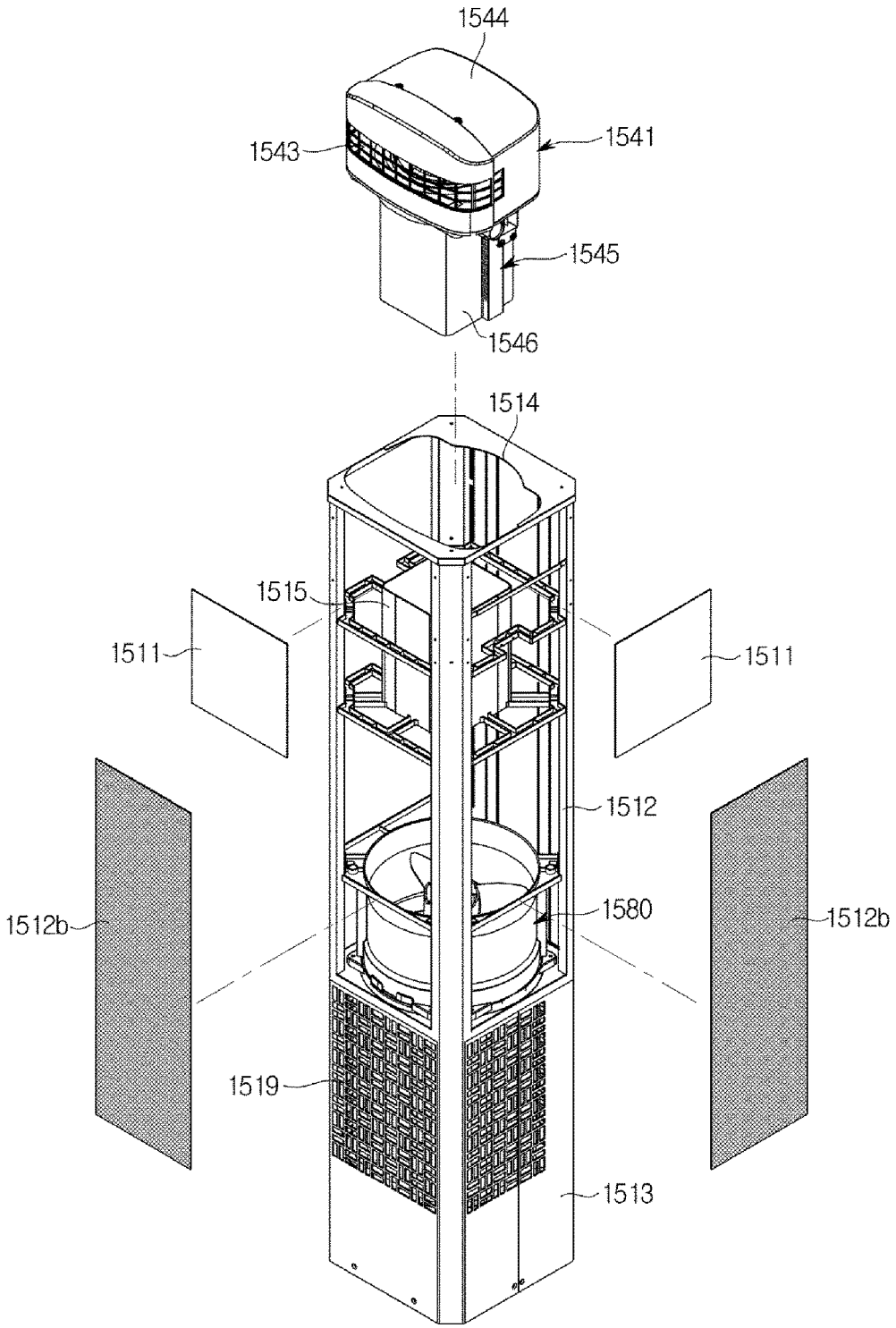

【Fig. 14】
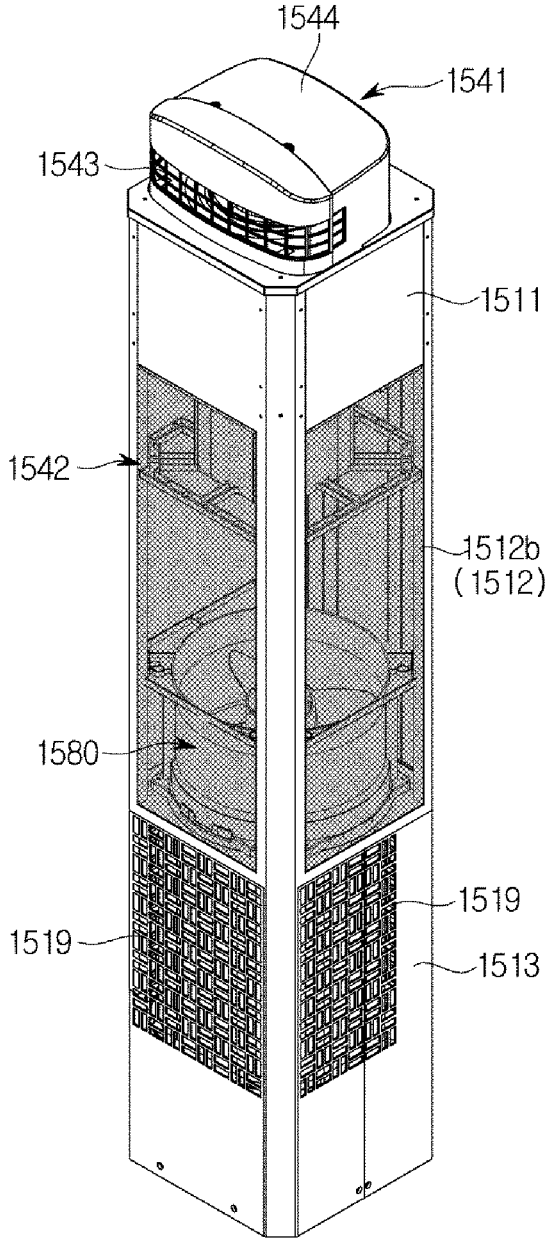

【Fig. 15】
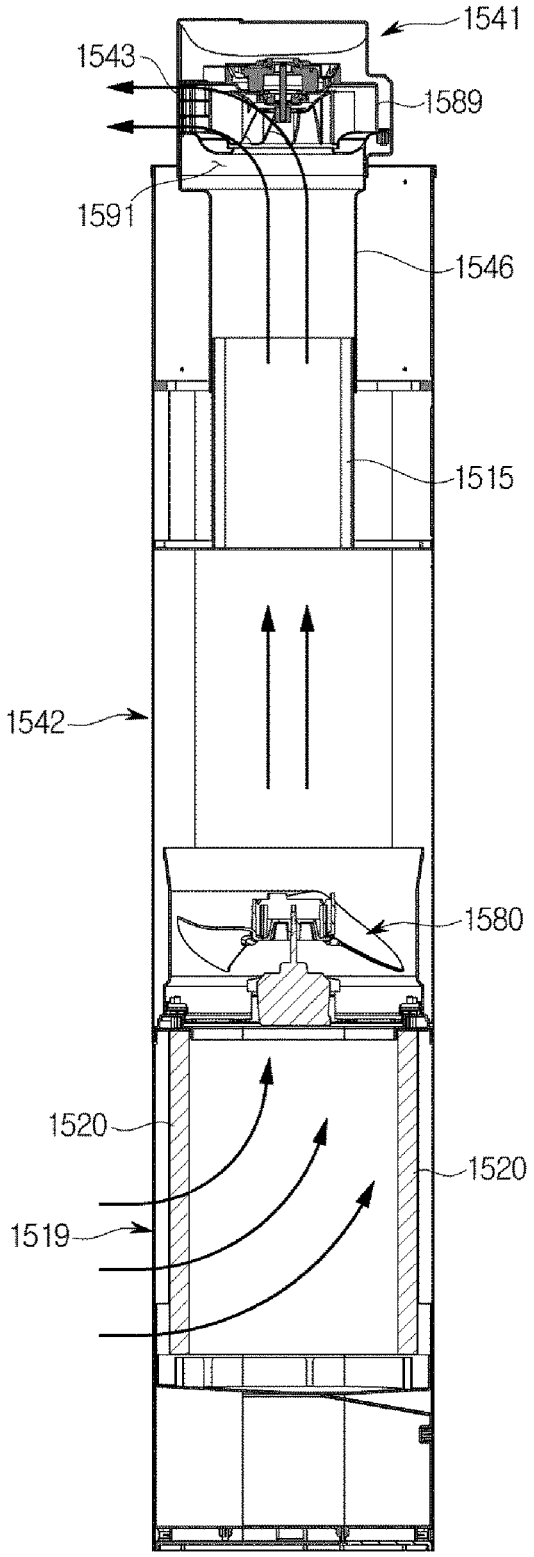

【Fig. 16】
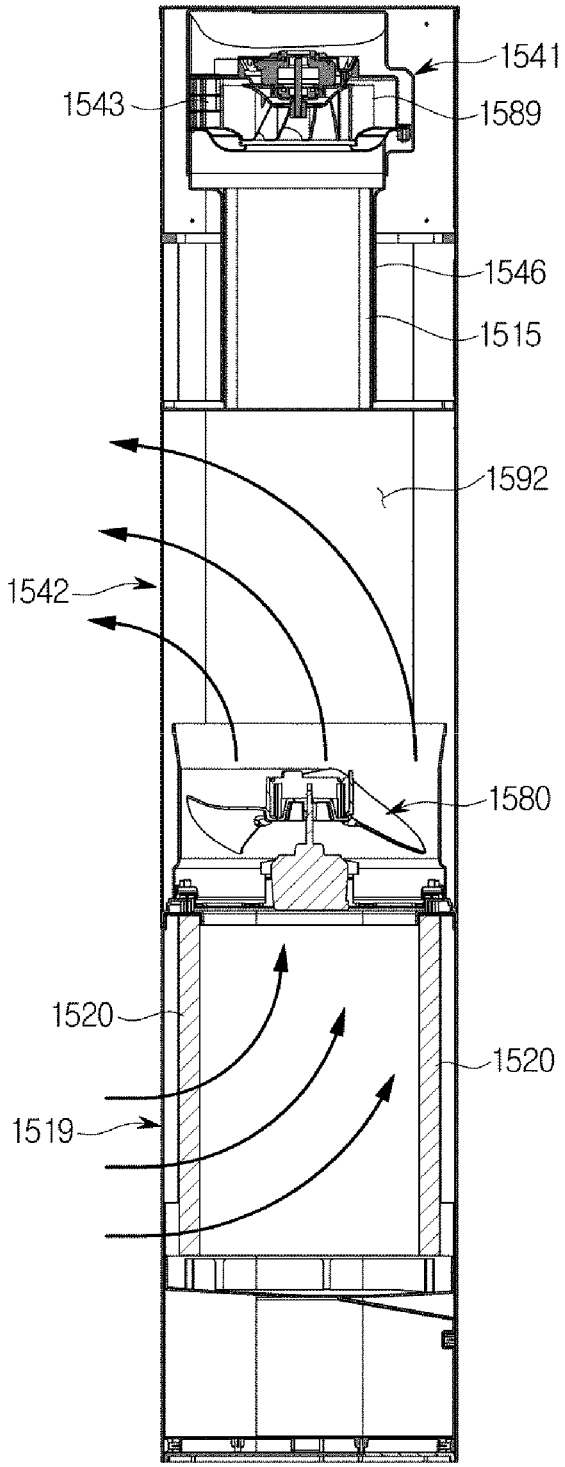

【Fig. 17】
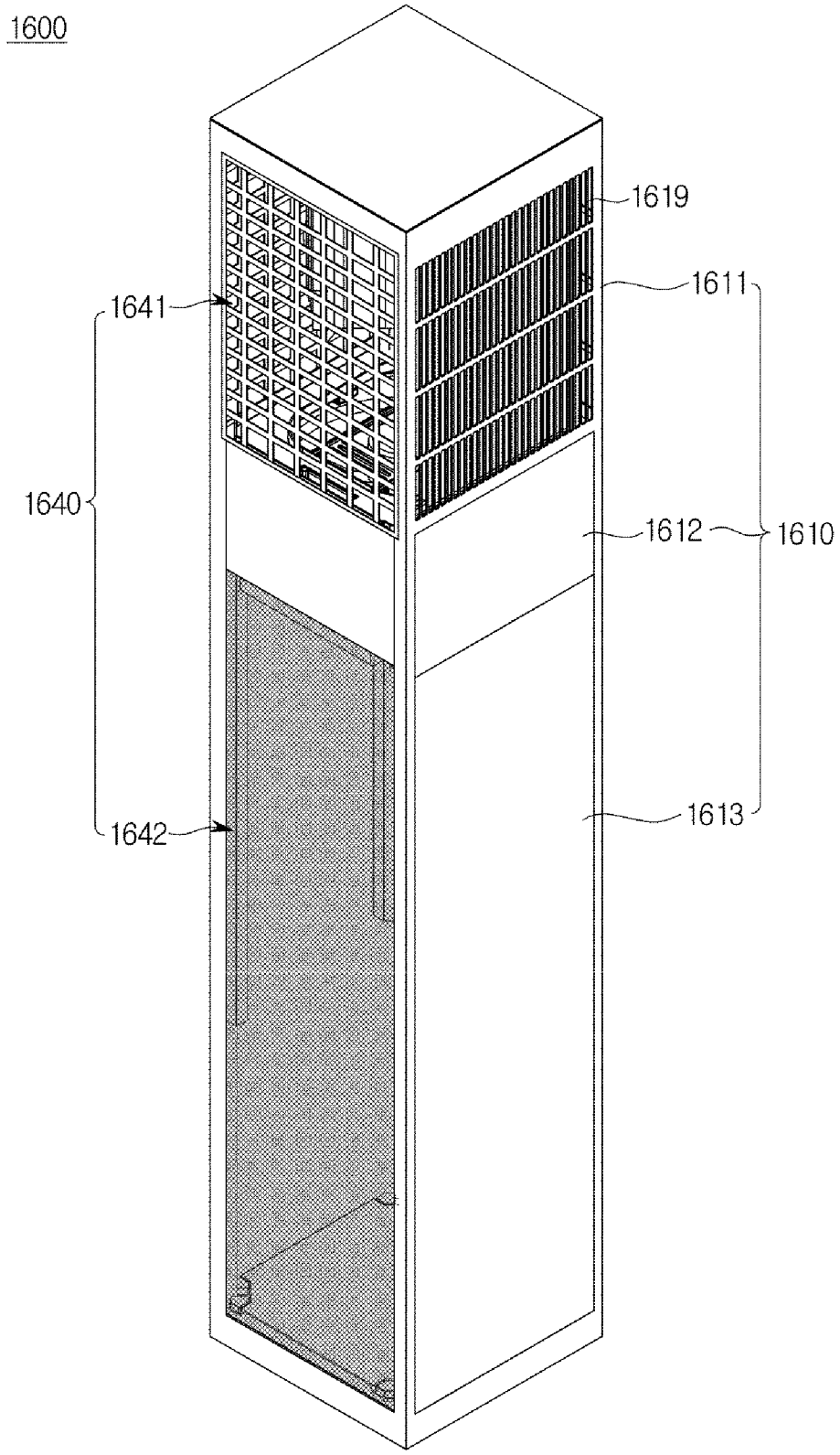

【Fig. 18】
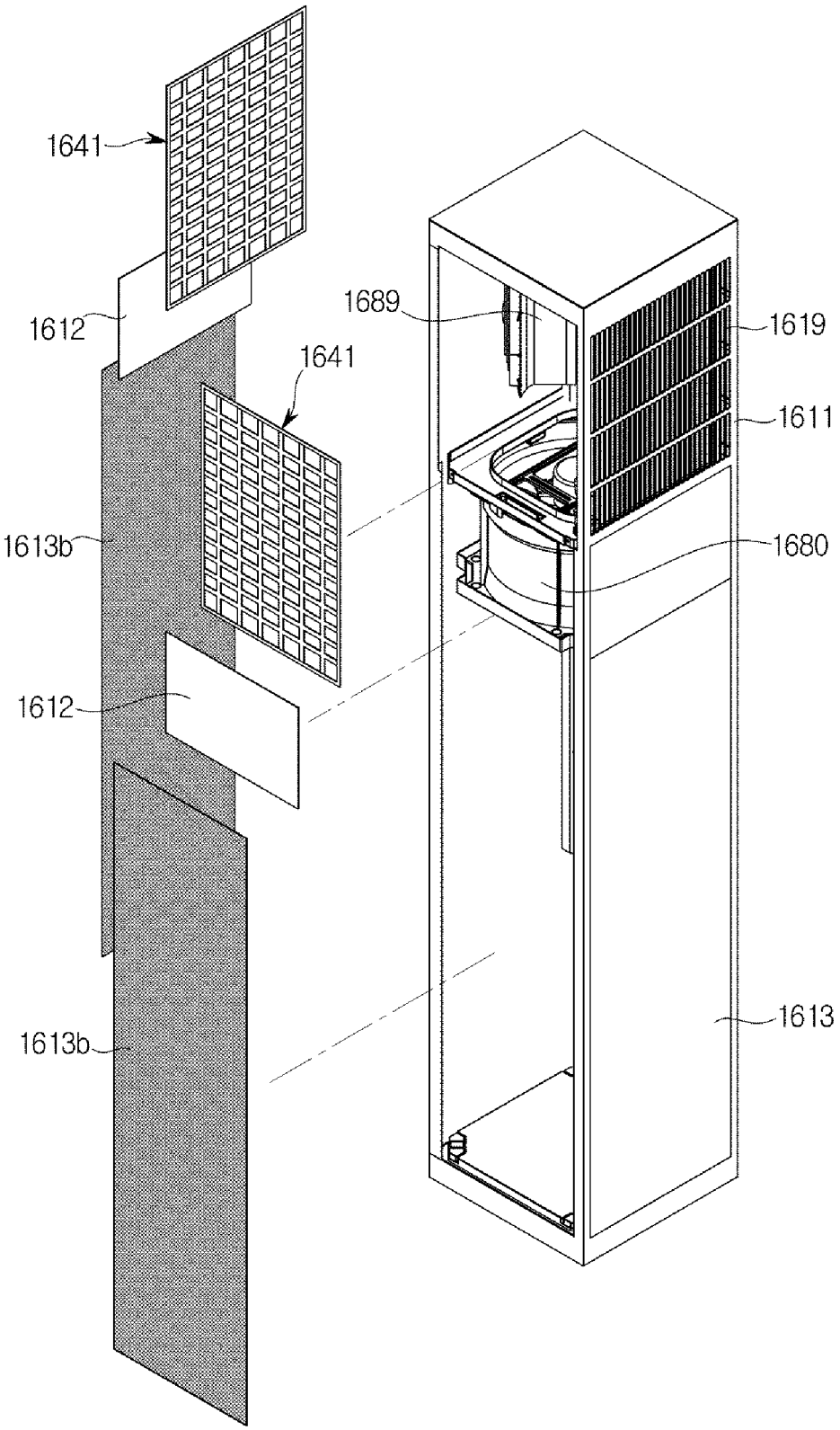

【Fig. 19】
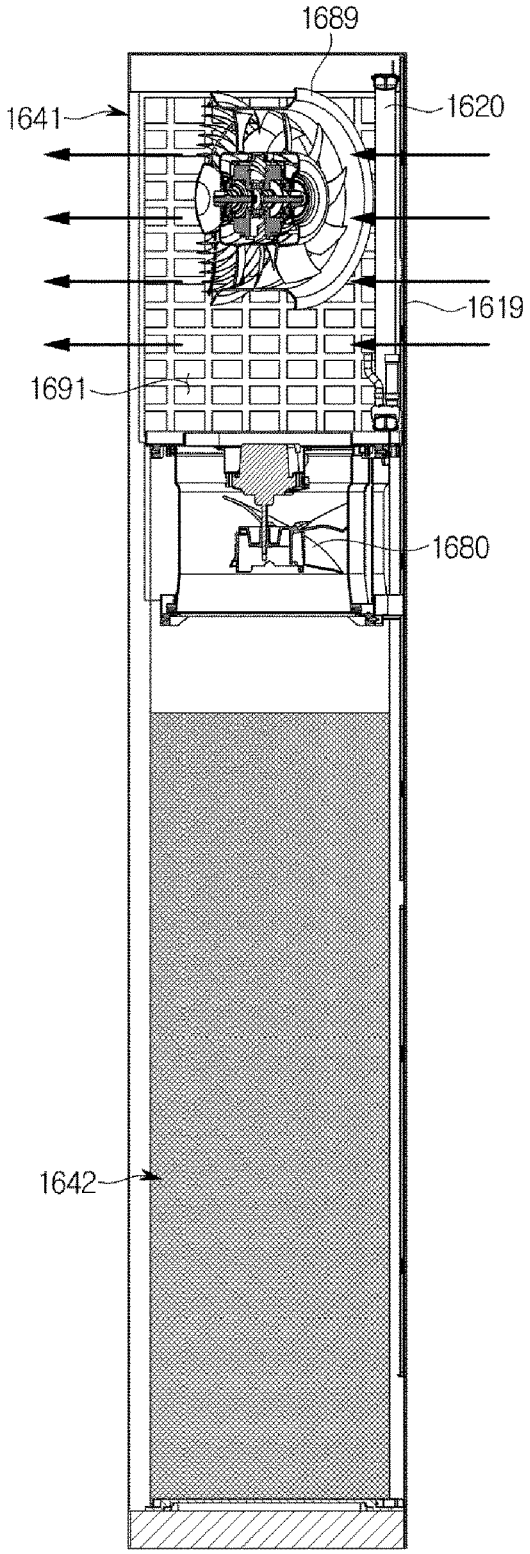

【Fig. 20】
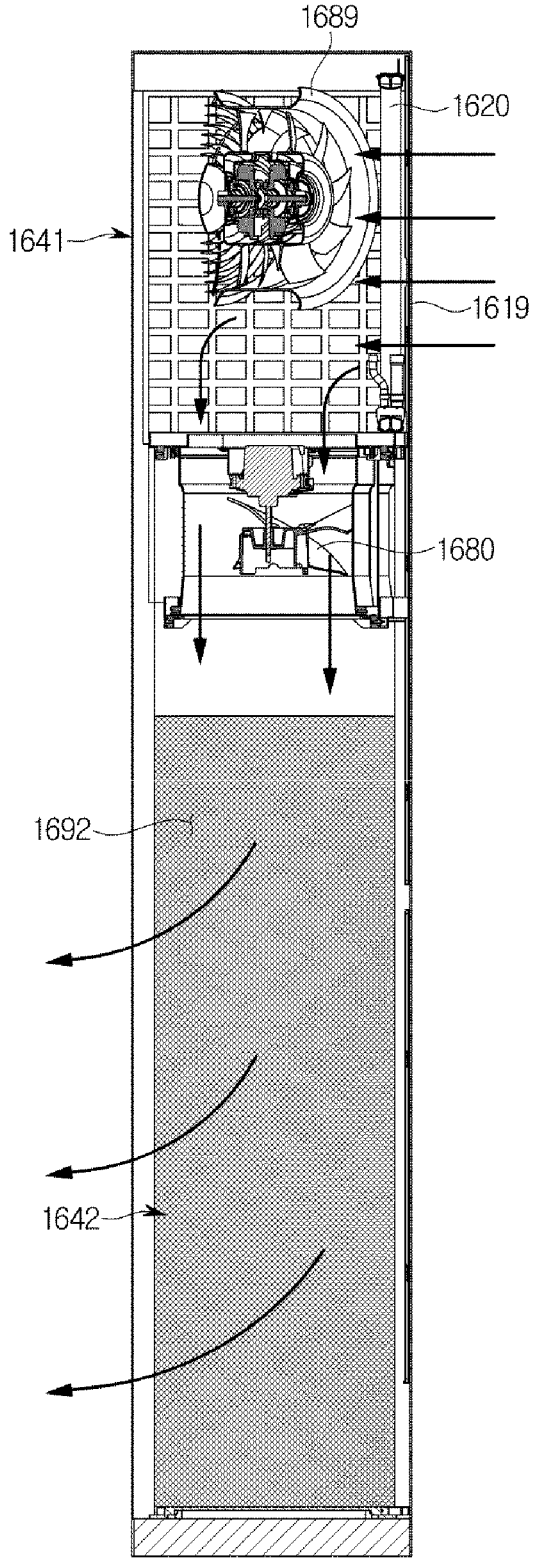

AIR CONDITIONER

CROSS-REFERENCE TO RELATED APPLICATIONS AND CLAIM OF PRIORITY

The present application claims priority under 35 U.S.C. § 365 and is a 371 National Stage of International Application No. PCT/KR2016/007565, filed Jul. 12, 2016, which claims the benefit of Korean Patent Application No. 10-2015-0101976, filed Jul. 17, 2015 and Korean Patent Application No. 10-2016-0016906, filed Feb. 15, 2016, the disclosures of which are fully incorporated herein by reference into the present disclosure as if fully set forth herein.

TECHNICAL FIELD

The present disclosure relates to an air conditioner, more particularly, to an air conditioner having a different air discharging method.

BACKGROUND

Generally, an air conditioner is an apparatus that uses a refrigeration cycle to control temperature, humidity, airflow, and distribution to be suitable for human activity, and to remove dust in the air. A compressor, a condenser, an evaporator, a blowing fan are provided as main components of the refrigeration cycle.

The air conditioner may be classified into a separate type air conditioner in which an indoor portion and an outdoor portion are separated, and an integrated type air conditioner in which an indoor portion and an outdoor portion are installed together in a single cabinet. The indoor portion of the separate type air conditioner includes a heat exchanger for exchanging heat with the air sucked into a panel, and a blowing fan for sucking indoor air into the panel and blowing the sucked air back into the indoor.

In a conventional manner, the indoor portion of the air conditioner is configured to minimize the heat exchanger and to increase revolutions per minute (RPM) of the blowing fan to maximize the wind speed and the air flow rate. As a result, the discharge temperature is lowered, and the discharge air forms a narrow and long flow path and discharged into the indoor space.

When a user directly touches the discharged air, the user can feel the cold and the uncomfortable feeling. On the other hand, when the user does not touch the discharged air, the user feels the heat and the uncomfortable feeling.

In addition, when the RPM of the blowing fan is increased to implement a high wind speed, the noise may be increased. In the case of a radiator type air conditioner configured to condition air without the blowing fan, a large panel may be needed to perform the same performance as the air conditioner provided with the blowing fan. In addition, as for the radiator type air conditioner, the cooling speed is also very slow and there is a problem that the construction cost is large.

SUMMARY

The present disclosure is directed to providing an air conditioner having various air discharge methods.

Further, the present disclosure is directed to providing an air conditioner capable of cooling and heating the room with a minimum wind speed at which a user feels comfortable.

Further, the present disclosure is directed to providing an air conditioner capable of cooling by using a cold air region formed in a cooling and a proximity region, through the convection at a minimum wind speed.

An air conditioner of present disclosure include a housing provided with an outer panel forming an appearance, and an opening formed in the outer panel; a heat exchanger configured to exchange heat with air introduced to the inside of the housing; a first discharge portion connected to the opening to discharge heat-exchanged air to the outside; a second discharge portion disposed in a lower side of the first discharge portion in the outer panel to discharge the heat-exchanged air; and a blowing fan disposed inside of the housing to move air, which is heat-exchanged by the heat exchanger, in a direction of the second discharge portion.

The heat-exchanged air may be selectively discharged to any one of the first discharge portion and the second discharge portion.

The blowing fan may be disposed between the first discharge portion and the second discharge portion.

The air conditioner may further include a door portion configured to open or close the first discharge portion, wherein the door portion may allow the air flow of the heat-exchanged air to discharge at least one of the first discharge portion and the second discharge portion by opening or closing the first discharge portion.

The second discharge portion may include a plurality of discharge holes formed in the outer panel and formed to penetrate an inner and outer surface of the outer panel.

The second discharge portion may be formed extended along a front surface and at least one side surface of the outer panel.

The housing may include a suction portion formed in the other side surface of an upper portion the outer panel, wherein the other side surface faces one side surface of the upper portion of the outer panel in which the first discharge portion is formed.

The air conditioner may further include an airflow controller installed inside of the second discharge portion to allow the heat exchanged air to be uniformly discharged to an entire area of the second discharge portion.

The airflow controller may be formed such that a front surface thereof is increasingly inclined to approach the second discharge portion as the front surface goes to the lower portion.

The airflow controller may be disposed such that the front surface thereof faces the blowing fan.

In accordance with another aspect of the present disclosure, an air conditioner includes a housing provided with an outer panel forming an appearance, and an opening formed in the outer panel; a heat exchanger configured to exchange heat with air introduced to the inside of the housing; a first discharge portion connected to the opening to discharge heat-exchanged air to the outside; a second discharge portion formed in a lower side of the first discharge portion in the outer panel to discharge the heat-exchanged air; a first discharge flow path configure to connect the heat exchanger to the first discharge portion; and a second discharge flow path configure to connect the heat exchanger to the second discharge portion.

The air conditioner may further include a first blowing fan disposed in the first discharge flow path to move air, which is heat-exchanged by the heat exchanger, to a direction of the first discharge portion.

The first discharge portion selectively discharges the heat exchanged air according to whether the first blowing fan is driven or not.

The air conditioner may further include a second blowing fan disposed inside of the housing to suck air in the outside of the housing.

The air conditioner may further include a door portion configured to open or close the first discharge portion, wherein the door portion may allow the air flow of the heat-exchanged air to discharge at least one of the first discharge portion and the second discharge portion by opening or closing the first discharge portion.

The first discharge portion may be selectively exposed to the outside of the housing and thus when the first discharge portion is pulled out to the outside of the housing, the heat-exchanged air is discharged through the first discharge portion and when the first discharge portion is inserted into the inside of the housing, the heat-exchanged air is discharged through the second discharge portion.

The second discharge portion may include a plurality of discharge holes formed in the outer panel and formed to penetrate an inner and outer surface of the outer panel.

The second discharge portion may be formed extended along a front surface and both side surfaces of the outer panel.

In accordance with still another aspect of the present disclosure, an air conditioner includes a housing having a suction portion and an opening, a first discharge portion provided at an upper portion of the housing, a second discharge portion provided below the first discharge portion and arranged to discharge air at a different air velocity than the air discharge from the first discharge portion, a heat exchanger disposed on an air flow path through which air introduced into the housing is discharged through the first discharge portion or the second discharge portion, and a blowing fan to move the heat exchanged air to the first discharge portion.

The suction portion may be provided below the second discharge portion.

An air conditioner can discharge heat-exchanged air at different wind speeds.

An air conditioner can change a blowing method of heat-exchanged air according to user's environment.

An air conditioner can condition the indoor air to prevent heat exchanged air from being directly blown to the user, so as to improve the satisfaction of the user.

BRIEF DESCRIPTION OF THE DRAWINGS

FIG. 1 is an exploded perspective view illustrating an air conditioner according to another embodiment.

FIG. 2 is an exploded perspective view illustrating a configuration of a second discharge portion in the air conditioner of FIG. 1.

FIG. 3 is an enlarged view illustrating an outer panel on which a discharge hole is disposed, in the air conditioner of FIG. 1.

FIG. 4 is an enlarged view illustrating an airflow controller in the air conditioner of FIG. 1.

FIG. 5 is a sectional view illustrating the airflow controller of FIG. 4 when viewing from above.

FIG. 6 is a cross-sectional view illustrating the air conditioner of FIG. 1.

FIG. 7 is a view illustrating the flow of air discharged from the second discharge portion in the air conditioner of FIG. 6.

FIG. 8 is a perspective view illustrating an air conditioner according to another embodiment.

FIG. 9 is an exploded-perspective view illustrating the air conditioner of FIG. 8.

FIG. 10 is a view illustrating the flow of air discharged from a first discharge portion in the air conditioner of FIG. 8.

FIG. 11 is a view illustrating the flow of air discharged from a second discharge portion in the air conditioner of FIG. 8.

FIG. 12 is a perspective view illustrating an air conditioner according to another embodiment.

FIG. 13 is an exploded-perspective view illustrating the air conditioner of FIG. 12.

FIG. 14 is a view illustrating air discharged through a first discharge portion of the air conditioner of FIG. 12.

FIG. 15 is a view illustrating the flow of air discharged from the first discharge portion in the air conditioner of FIG. 12.

FIG. 16 is a view illustrating the flow of air discharged from a second discharge portion in the air conditioner of FIG. 12.

FIG. 17 is a perspective view illustrating an air conditioner according to another embodiment.

FIG. 18 is an exploded-perspective view illustrating the air conditioner of FIG. 17.

FIG. 19 is a view illustrating the flow of air discharged through a first discharge portion of the air conditioner of FIG. 17.

FIG. 20 is a view illustrating the flow of air discharged from a second discharge portion in the air conditioner of FIG. 17.

DETAILED DESCRIPTION

Embodiments described in the present disclosure and configurations shown in the drawings are merely examples of the embodiments of the present disclosure, and may be modified in various different ways at the time of filing of the present application to replace the embodiments and drawings of the present disclosure.

In addition, the same reference numerals or signs shown in the drawings of the present disclosure indicate elements or components performing substantially the same function.

Also, the terms used herein are used to describe the embodiments and are not intended to limit and/or restrict the present disclosure. The singular forms "a," "an" and "the" are intended to include the plural forms as well, unless the context clearly indicates otherwise. In this present disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

It will be understood that, although the terms first, second, third, etc., may be used herein to describe various elements, but elements are not limited by these terms. These terms are only used to distinguish one element from another element. For example, without departing from the scope of the present disclosure, a first element may be termed as a second element, and a second element may be termed as a first element. The term of "and/or" includes a plurality of combinations of relevant items or any one item among a plurality of relevant items.

Hereinafter, exemplary embodiments of the present disclosure will be described in detail with reference to the accompanying drawings.

A refrigeration cycle of an air conditioner is provided with a compressor, a condenser, an expansion valve, and an evaporator. The refrigeration cycle is a series of processes of compression-condensation-expansion-evaporation, and a high-temperature air exchanges heat with a low-temperature refrigerant, and then the low-temperature air is supplied to the indoor.

The compressor compresses refrigerant gas into a state of high temperature and high pressure and discharges the refrigerant gas at the high temperature and pressure, and the discharged refrigerant gas flows into the condenser. The condenser condenses the compressed refrigerant into a liquid phase and the heat is discharged to the surroundings through the condensation process. The expansion valve expands the liquid refrigerant in the high-temperature and high-pressure state, which is condensed in the condenser, into the liquid refrigerant in the low-pressure state. The evaporator evaporates the refrigerant, which is expanded in the expansion valve. The evaporator uses the evaporation latent heat of the refrigerant to achieve a refrigerating effect by the heat exchange with the object to be cooled, and returns the refrigerant gas at the low-temperature and pressure to the compressor. Through this cycle, an air temperature of the indoor space may be adjusted.

The outdoor portion of the air conditioner refers to a portion composed of a compressor and an outdoor heat exchanger in the refrigeration cycle. The expansion valve may be located either in the indoor portion or the outdoor portion, and the indoor heat exchanger is placed in the indoor portion of the air conditioner.

The present disclosure relates to an air conditioner configured to cool an indoor space, wherein the outdoor heat exchanger serves as a condenser and the indoor heat exchanger serves as an evaporator. For convenience of description, the indoor portion including the indoor heat exchanger is referred to as an air conditioner, and the indoor heat exchanger is referred to as a heat exchanger.

The indoor portion of the air conditioner includes a housing having at least one opening and forming an outer appearance of the housing, a heat exchanger exchanging heat with air introduced into the housing, a blowing portion circulating air to the inside or outside of the housing, and an discharging portion discharging air to the outside of the housing.

The housing includes a front panel on which at least one opening is disposed, a rear panel disposed in a rear side of the front panel, a side panel provided between the front panel and the rear panel, and upper and lower panels disposed on upper and lower sides of the side panel. The at least one opening is provided in a circular shape, and at least two or more of the openings may be disposed apart from each other in a vertical direction of the front panel. A suction portion may be disposed on the rear panel to allow external air to be sucked into the inside of the housing.

The suction portion is provided on the rear panel disposed on the rear side of the heat exchanger to guide air in the outside of housing into the housing. The air introduced into the housing through the suction portion absorbs heat or loses the heat through the heat exchanger. The air exchanged with heat by passing through the heat exchanger is discharged to the outside of the housing through the discharge portion by the blowing portion.

The blowing portion may include a blowing fan and a blow grill.

A blow grill may be provided in a discharge direction of the blowing fan. In the present embodiment, a mixed flow fan is applied as the blowing fan, but is not limited thereto. Alternatively, any kind of blowing fan may be applied as long as capable of flowing air, which is introduced from the outside of the housing, back to discharge the outside of the housing. For example, a blowing fan may be a cross fan, a turbo fan, or a sirocco fan. The number of the blowing fans is not limited, and at least one blowing fan may be provided to correspond to at least one opening according to the present embodiment. The blowing fan is disposed in front of the suction portion, and the heat exchanger may be disposed between the blowing fan and the suction portion. A first discharge portion may be disposed in front of the blowing fan.

The blowing portion may be provided with a fan driver provided at the center of the blowing fan to drive the blowing fan. The fan driver may include a motor.

The blow grill is disposed in front of the blowing fan to guide the air flow. Further, since the blow grill is disposed between the blowing fan and the discharge portion, the influence, which is applied from the outside to the blowing fan, may be minimized.

The blow grill may include a plurality of blades. The number, shape, and arrangement angle of the plurality of blades may be adjusted to control the wind direction or air volume of the air blown from the blowing fan to the discharge portion.

A door operator described later may be provided at the center of the blow grill. The door operator and the fan driver may be arranged on the same line in the front-rear direction. With this configuration, a plurality of blades of the blow grill may be disposed in the front of the blowing fan blades.

The blowing portion may include a duct. The duct is provided in a circular shape surrounding the blowing fan to guide the flow of air flowing to the blowing fan. That is, the duct may guide the air, which is sucked through the suction portion and passed through the heat exchanger, to flow to the blowing fan.

The heat exchanger is disposed between the blowing fan and the suction portion to absorb heat from the air introduced through the suction portion or to transfer heat to the air introduced through the suction portion. The heat exchanger may include a tube and a header coupled to the upper and lower sides of the tube. However, the type of heat exchanger is not limited.

At least one heat exchanger disposed inside the housing may be provided to correspond to the number of openings.

The discharge portion is provided in the housing, wherein air, which is heat-exchanged inside of the housing, may be discharged to the outside of the housing. The discharge portion includes a first discharge portion and a second discharge portion, which will be described later.

The air conditioner may operate with a plurality of operation modes. The plurality of operation modes may include a first mode configured to discharge heat-exchanged air to the opening provided in the housing and a second mode configured to discharge the heat-exchanged air to a discharge plate provided in the housing. In addition, the air conditioner may further include a third mode configured to discharge the heat-exchanged air to both of the opening and the discharge plate. The discharge plate will be described later.

The first mode, the second mode, and the third mode are configured to allow the heat-exchanged air to be discharged through the first discharge portion, the second discharge portion, and the first and second discharge portions, described below. That is, the air heat-exchanged by the heat exchanger may be discharged to the outside of the air conditioner through the first discharge portion and the second discharge portion by the blowing fan.

In the first mode, the heat-exchanged air is discharged to the first discharge portion. However, the heat-exchanged air may be discharged to not only the first discharge portion, but a part of the air may be discharged to the second discharge portion. That is, in the first mode, most of the heat-exchanged air may be discharged to the first discharge portion. Even in the second mode, most of the heat-exchanged air may be discharged to the second discharge portion as in the first mode.

The air passing through the blowing portion may be discharged to the outside of the housing through the discharge portion.

The discharge portion may include the first discharge portion and the second discharge portion. The heat-exchanged air may be discharged through at least one of the first discharge portion and the second discharge portion. Further, the heat-exchanged air may be selectively discharged through any one of the first discharge portion and the second discharge portion.

The first discharge portion is configured to discharge air through an opening disposed in the housing. When the air conditioner is in the first mode, the heat-exchanged air is discharged to the outside of the housing through the first discharge portion. The first discharge portion is configured to allow the heat-exchanged air to be directly discharged to the outside. The first discharging portion may be exposed to the outside of the housing.

The first discharge portion is provided in the blowing direction of the blowing fan to allow the heat-exchanged air to be directly discharged to the outside. That is, the first discharge portion is disposed in front of the blowing fan of the blowing portion and thus the air blown from the blowing portion is directly discharged to the first discharge portion.

The air blown by the blowing fan may flow through a first discharge flow path disposed between the blowing fan and the first discharge portion. The first discharge flow path may be formed by a discharge guide portion.

The first discharge portion may be formed by a guide opening. The guide opening may be connected to the opening, and may be provided to form the first discharge portion along an inner circumferential surface thereof. The guide opening may be exposed to the outside through the opening of the housing, and a door portion described later may be moved and seated in the guide opening. The guide opening may be disposed in the opening of the housing, and configured to form the first discharge portion along the inner circumferential surface thereof.

The first discharge portion may be opened and closed by the door portion.

The door portion is configured to open and close the first discharge portion, and configured to allow the heat-exchanged air to be selectively discharged to the outside of the housing through the first discharge portion. By opening and closing the first discharge portion, the door portion may allow the heat-exchanged air to be discharged to the outside of the housing through at least one of the first and second discharge portions.

The door portion may be configured to switch a door opening position in which the first discharge portion is opened and a door closing position in which the first discharge portion is closed. The door portion may be configured to allow the door opening position and the door closing position to be switchable in the front-rear direction.

Particularly, the door portion may include a door blade and a door operator configured to operate the door blade.

The door blade may be formed in a circular shape to correspond to the shape of the first discharge portion. When the door portion is at the door opening position, the door blade is apart from the guide opening. When the door portion is at the door closing position, the door blade abuts the guide opening to close the first discharge portion.

The door blade may include a blade body formed in a circular shape corresponding to the first discharge portion, and a blade coupling portion extended from the blade body and coupled to the door operator.

The blade body may be provided in a substantially circular plate shape. The blade body may be provided such that one side thereof faces the outside of the housing and the other side thereof faces the blowing portion.

A display may be provided on one side of the blade body to display an operation state of the air conditioner or to allow a user to operate the air conditioner.

The door operator may be configured to allow the door blade to be movable. The door operator may include a motor. The door operator may be coupled to the blade coupling portion of the door blade so that the door blade may be moved.

The above mentioned blow grill may be disposed along the periphery of the door operator. The air, which is blown from the blowing fan provided on a back surface of the blow grill, may be discharged forward through the blow grill.

The second discharge portion is configured to discharge air through an outer panel. When the air conditioner is in the second mode, the heat-exchanged air may be discharged to the outside of the housing through the second discharge portion. With this configuration, the heat-exchanged air may be discharged to the outside while a wind speed thereof is reduced. The second discharge portion may include a plurality of discharge holes disposed in the discharge plate, described later, and formed to penetrate inner and outer surfaces of the discharge plate. The opening of the housing may be disposed on the discharge plate, but is not limited thereto. In other words, for example, the opening and the discharge plate may be arranged on different surfaces of the housing.

When the heat-exchanged air is discharged to the outside of the housing through the second discharge portion, the air blown by the blowing fan may flow through a second discharge flow path disposed between the blowing fan and the second discharge portion. The second discharge flow path may be formed by a discharge guide portion and a discharge panel, described later.

The outer panel may include an outer panel forming an outer appearance thereof and a discharge panel allowing the heat-exchanged air to be discharged. The discharge panel may be a portion of the outer panel or a portion of the discharge portion.

The discharge panel is configured to form the second discharge flow path. The heat-exchanged air may be discharged to the outside of the air conditioner, at a low speed through the second discharge flow path formed by the discharge panel and the discharge plate, described later.

In this embodiment, the discharge panel is disposed on the front surface of the air conditioner, but is not limited thereto. That is, the discharge panel may be disposed on at least one of the front surface, the right surface, the left surface, the rear surface, and the upper surface of the air conditioner.

The discharge panel may include a flow path forming frame and a discharge plate.

The flow path forming frame may be configured to partition the inside of the housing and the second discharge flow path. The flow path forming frame may prevent the heat-exchanged air from being introduced into the housing again. In this embodiment, the flow path forming frame may be formed to be extended from the blow grille and then connected to the outer panel.

The second discharge portion may be disposed on the discharge plate. The discharge plate and the second discharge portion may be referred to as a plate discharge portion.

The shape of the second discharge portion is not limited, but in this embodiment, the second discharge portion has the shape of a plurality of discharge holes. The second discharge portion may be provided to penetrate the front surface and the rear surface of the discharge plate. The discharge plate may be provided on more outer side than the flow path forming frame so as to form the second discharge path between the flow path forming frame and the discharge plate.

The second discharge portion may include a discharge region formed in at least a part of the discharge plate. In the discharge region, the plurality of discharge holes may be uniformly distributed, or alternatively focused on at least a part. In this embodiment, the plurality of discharge holes may be uniformly distributed in the discharge region.

The discharge region may be formed on at least a part of the discharge plate, but is not limited thereto. Alternatively, the discharge region may be formed on all surfaces of the discharge plate.

The third mode is a mode in which the heat-exchanged air is distributed and discharged to the first discharge portion and the second discharge portion. A distribution amount to each discharge portion may be determined by setting and controlled by a controller.

The discharge portion may include the first discharge flow path through which the heat-exchanged air flows to the first discharge portion and the second discharge flow path through which the heat exchanged air flows to the second discharge portion. The first discharge flow path and the second discharge flow path may be referred to as a discharge flow path and a radiation discharge flow path, respectively.

The air blown by the blowing fan may flow through at least one of the first discharge flow path and the second discharge flow path.

In the first mode, the air blown by the blowing fan may flow through the first discharge flow path disposed between the blowing fan and the first discharge portion. In addition, in the second mode, the air blown by the blowing fan may flow through the second discharge flow path disposed between the blowing fan and the second discharge portion.

The discharge portion may include a discharge guide portion. The air blown by the blowing fan may be controlled by the discharge guide portion. The discharge guide portion is provided in front of the blowing portion to allow air flowing from the blowing portion, to flow through at least one of the first discharge flow path and the second discharge flow path.

The discharge guide portion may include a guide body and a guide groove.

The guide body is configured to form a first discharge flow path inside thereof. The guide body may be provided in a cylindrical shape having a hollow portion. Particularly, the guide body may be formed in the shape of a tube such that one side thereof faces the blowing portion and the other side thereof faces the first discharge part.

The guide groove is configured to allow the second discharge flow path to be passed. The guide groove may be provided on the guide body. The shape of the guide groove is not limited, and thus the guide groove may have a variety of shapes as long as capable of allowing air to flow outwardly of the guide body by being provided in the guide body. In the present embodiment, the guide groove may be formed in the guide body to have a plurality of holes along the circumference of the guide body.

In the first mode, the door portion opens the first discharge portion. In this case, the air blown from the blowing portion is discharged to the first discharge portion through the first discharge flow path disposed inside the guide body.

In the second mode, the door portion closes the first discharge portion. In this case, one side of the guide body is blocked by the door portion, and thus the air blown from the blowing portion is discharged to the second discharge portion by passing through the guide groove disposed in the guide body.

The discharge plate may include a plate coupling portion. The plate coupling portion is configured to allow the discharge plate to be coupled to the housing or the guide opening.

The plate coupling portion may be formed along the outer periphery of the discharge plate to be coupled to the housing. Further, the plate coupling portion may be formed along the outer periphery of the opening of the discharge plate to be coupled to the guide opening.

The plate coupling portion may protrude from the discharge plate. The plate coupling portion may include a plate locking groove having a hole shape, and the plate locking groove may be locked by a locking protrusion, described later.

The plate coupling portion may include a first plate coupling portion configured to allow the discharge plate to be coupled to the housing, and a second plate coupling portion configured to allow the discharge plate to be coupled to the guide opening.

At least one first plate coupling portion may be provided along the outer periphery of the discharge plate. The first plate coupling portion is coupled to the housing and allows the housing and the discharge plate to be coupled to each other.

In the housing, a first locking protrusion may be provided at a position corresponding to the first plate coupling portion. In this embodiment, the first locking protrusion is disposed at a position corresponding to the first plate coupling portion at the outer periphery of the flow path forming frame. However, the arrangement of the first locking protrusion is not limited, and the first locking protrusion may be disposed in a variety of positions as long as the locking protrusion is provided to correspond to the first plate coupling portion in the housing to allow the housing to be coupled to the discharge plate.

When the discharge plate is brought into close contact with the housing, the first plate locking groove of the first plate coupling portion is formed to be locked by the first locking protrusion. Accordingly, the discharge plate may be mounted on the housing.

The number of the first plate coupling portion and the first locking protrusion is not limited.

At least one second plate coupling portion may be provided along the outer periphery of the opening. The second plate coupling portion is coupled to the guide opening and allows the guide opening and the discharge plate to be coupled to each other.

A guide insertion groove into which the second plate coupling portion is inserted may be formed in the guide opening. When the discharge plate is brought into close contact with the guide opening, the second plate coupling portion may be inserted by passing through the guide opening through the guide insertion groove. The guide insertion groove may be disposed along the circumference of the guide opening by corresponding to the second plate coupling portion provided at the outer periphery of the opening.

The second plate coupling portion may be inserted into the guide insertion groove, and the inserted second plate coupling portion may allow the discharge plate to be coupled to the guide opening since the second locking protrusion is locked by the second plate locking groove. As mentioned above, since the discharge plate is coupled to the guide opening, the opening may be connected to the first discharge portion.

The number of the second plate coupling portion, the second locking protrusion, and the guide insertion groove is not limited, but, according to the present embodiment, four second plate coupling portions, four second locking protrusions, and four guide insertion grooves may be provided at regular intervals.

Hereinafter an operation of the air conditioner according to the present disclosure will be described.

Air introduced into the housing from the outside exchanges heat with the heat exchanger. The air conditioned by the heat exchanger is discharged to the outside of the housing by the blowing portion.

The air conditioner discharges the air passing through the heat exchanger, to the outside through at least one of the first discharge portion and the second discharge portion. That is, as in the first mode, the air conditioner may perform an intensive air conditioning by discharging the air through the first discharge portion, or as in the second mode, the air conditioner may slowly perform the air conditioning in the entire of the indoor, by discharging the air through the second discharge portion.

The first discharge portion may be opened and closed by operating the door portion. The heat-exchanged air is discharged through the first discharge portion when the first discharge portion is opened, and the heat-exchanged air is discharged through the second discharge portion when the first discharge portion is closed.

Hereinafter the first mode will be described in detail.

In the first mode, the heat exchanged air is discharged through the first discharge portion. In the first mode, the door portion is positioned at the door opening position, and the door blade is apart from the guide opening so that the first discharge portion is opened.

In this case, the air blown from the blowing portion may flow into the first discharge portion through the first discharge flow path formed by the guide body.

When the air is discharged to the outside of the housing through the first discharge portion, the air may be discharged to the outside while the wind speed thereof is maintained by the blowing portion.

Next, the second mode will be described.

In the second mode, the heat-exchanged air is discharged through the second discharge portion. In the second mode, the door portion is positioned at the door closing position, and the door blade is brought into contact with the guide opening so that the first discharge portion is closed.

In this case, the air blown from the blowing portion flows through the guide groove disposed in the guide body since the first discharge portion is closed by the door blade. Accordingly, the air blown from the blowing portion flows to the second discharge portion through the second discharge flow path.

When the air is discharged to the outside of the housing through the second discharge portion, the wind speed of the air may be reduced while passing through the plurality of discharge holes and then discharged to the outside at the low speed.

With this configuration, a user can cool or heat the room with a wind speed that feels comfortable.

In the above description, the first discharge portion and the second discharge portion may be referred to as a high-speed discharge portion and a low-speed discharge portion, respectively.

Next, the third mode will be described.

The third mode is a mode in which heat-exchanged air is distributed to the first discharge portion and the second discharge portion and then discharged to the outside of the housing. The air distribution amount to each discharge portion may be adjusted by the setting and by the controller. In addition, by applying a temperature sensor, the air distribution amount may be adjusted by the surrounding environment.

Hereinafter, an air conditioner according to an embodiment will be described.

The description of the same configuration as those shown in the above description will be omitted.

FIG. 1 is an exploded perspective view illustrating an air conditioner according to another embodiment, FIG. 2 is an exploded perspective view illustrating a configuration of a second discharge portion in the air conditioner of FIG. 1, FIG. 3 is an enlarged view illustrating an outer panel on which a discharge hole is disposed, in the air conditioner of FIG. 1, FIG. 4 is an enlarged view illustrating an airflow controller in the air conditioner of FIG. 1, FIG. 5 is a sectional view illustrating the airflow controller of FIG. 4 when viewing from above, FIG. 6 is a cross-sectional view illustrating the air conditioner of FIG. 1, and FIG. 7 is a view illustrating the flow of air discharged from the second discharge portion in the air conditioner of FIG. 6.

Referring to FIGS. 1 to 7, an indoor portion of an air conditioner 1300 includes a housing 1310 having at least one opening and forming an outer appearance thereof, a heat exchanger 1320 exchanging heat with air introduced into the inside of the housing 1310, a blowing portion (not shown) circulating air to the inside or outside of the housing 1310, and a discharge portion 1340 discharging air blown from the blowing portion to the outside of the housing 1310.

The housing 1310 may include an upper panel 1311 and a lower panel 1312. The lower panel 1312 may include a rear panel 1312*a*, and a front panel 1312*b* in which a second discharge portion 1342 is formed.

The discharge portion 1340 may include a first discharge portion 1341 and the second discharge portion 1342. The heat-exchanged air may be discharged through at least one of the first discharge portion 1341 and the second discharge portion 1342. Further, the heat-exchanged air may be selectively discharged through any one of the first discharge portion 1341 and the second discharge portion 1342.

The first discharge portion 1341 is configured to discharge air through an opening disposed in the housing 1310. The first discharge portion 1341 is provided to allow the heat-exchanged air to be directly discharged to the outside. The first discharge portion 1341 may be exposed to the outside of the housing 1310.

The air blown by a first blowing fan 1389 may flow through a first discharge flow path 1391 disposed between the first blowing fan 1389 and the first discharge portion 1341.

The first discharge portion 1341 may be opened and closed by a door portion 1360.

The door portion 1360 is configured to open and close the first discharge portion 1341 and configured to allow the heat-exchanged air to be selectively discharged to the outside of the housing 1310 through the first discharge portion 1341. By opening and closing the first discharge portion 1341, the door portion 1360 may allow the heat-exchanged air to flow toward at least one of the first discharge portion 1341 and the second discharge portion 1342.

The second discharge portion 1342 is configured to discharge air through an outer panel. When the air conditioner 1300 is in the second mode, the heat-exchanged air may be discharged to the outside of the housing 1310 through the second discharge portion 1342. With this configuration, the heat-exchanged air may be discharged to the outside while a wind speed thereof is reduced. The second discharge portion 1342 may include a plurality of discharge holes 1342*a* formed to penetrate inner and outer surfaces of the discharge plate. According to an example, the second discharge portion 1342 may be provided in a shape extended along a front surface and opposite side surfaces of the outer panel.

When the heat-exchanged air is discharged to the outside of the housing 1310 through the second discharge portion 1342, air blown by a second blowing fan 1380 may flow through a second discharge flow path 1392 provided between the heat exchanger 1320 and the second discharge portion 1342. The second blowing fan 1380 may be disposed between the first discharge portion 1341 and the second discharge portion 1342. The second blowing fan 1380 may be fixed such that a fan 1381 is supported by a support 1382 installed in an upper end of an airflow controller 1370 described later.

The air conditioner 1300 may further include the airflow controller 1370 configured to allow the heat-exchanged air to be uniformly discharged to the overall area of the second discharge portion 1342.

The airflow controller 1370 may be installed in the second discharge portion 1342. The airflow controller 1370 may have a shape such that a front surface 1371 is increasingly inclined to approach the second discharge portion 1342 as the front surface 1371 goes to the lower portion. The front surface 1371 of the airflow controller 1370 may be placed to face the blowing fan 1380. The front surface 1371 of the airflow controller 1370 may have a rounded-shape that is recessed to the rear side. A both side surface 1372 bent in opposite sides of the front surface 1371 may be formed in the airflow controller 1370. Accordingly, the airflow controller 1370 may be configured to guide the heat-exchanged air, which is moved through the second discharge flow path 1392, to be uniformly discharged to the overall area of the second discharge portion 1342.

Hereinafter, an air conditioner according to another embodiment will be described.

The description of the same configuration as those shown in the above description will be omitted.

FIG. 8 is a perspective view illustrating an air conditioner according to another embodiment, FIG. 9 is an exploded-perspective view illustrating the air conditioner of FIG. 8, FIG. 10 is a view illustrating the flow of air discharged from a first discharge portion in the air conditioner of FIG. 8, and FIG. 11 is a view illustrating the flow of air discharged from a second discharge portion in the air conditioner of FIG. 8.

Referring to FIGS. 8 to 11, an indoor portion of an air conditioner 1400 includes a housing 1410 having at least one opening and forming an outer appearance thereof, a heat exchanger 1420 exchanging heat with air introduced into the inside of the housing 1410, a blowing portion 1480 and 1489 circulating air to the inside or outside of the housing 1410, and a discharge portion 1440 discharging air blown from the blowing portion 1480 and 1489 to the outside of the housing 1410.

The housing 1410 may include an upper panel 1411, a middle panel 1412 and a lower panel 1413. The middle panel 1412 may include a discharge panel 1412*b* in which a second discharge portion 1442 is disposed.

A first discharge portion 1441 described later may be provided on the upper panel 1411. The second discharge portion 1442 described later may be provided in the middle panel 1412. A suction portion 1419 may be provided respectively in the rear side of the middle panel 1412 and in the rear side of the lower panel 1413. However, the position of the upper panel 1411, the middle panel 1412 and the lower panel 1413 is not limited thereto.

The discharge portion 1440 may include the first discharge portion 1441 and the second discharge portion 1442. The heat-exchanged air may be discharged through at least one of the first discharge portion 1441 and the second discharge portion 1442. Further, the heat-exchanged air may be selectively discharged through any one of the first discharge portion 1441 and the second discharge portion 1442.

The first discharge portion 1441 is configured to discharge the air through an opening disposed in the housing 1410. The first discharge portion 1441 is provided to allow the heat-exchanged air to be directly discharged to the outside. The first discharge portion 1441 may be exposed to the outside of the housing 1410.

The air blown by a first blowing fan 1489 may flow through a first discharge flow path 1491 disposed between the first blowing fan 1489 and the first discharge portion 1441. Particularly, the first blowing fan 1489 sucks air, which is introduced to the inside of the housing 1410 by a second blowing fan 1480, to an upper side of the housing 1410 in which the first discharge portion 1441 is provided, and then moves the air to the first discharge portion 1441. The first blowing fan 1489 may be disposed between the first discharge portion 1441 and the second discharge portion 1442. The first blowing fan 1489 may be fixed by being supported by a support 1490 installed in an upper side of the middle panel 1412.

The first discharge portion 1441 may be opened and closed by the door portion 1460. The door portion 1460 is configured to open and close the first discharge portion 1441 and configured to allow the heat-exchanged air to be selectively discharged to the outside of the housing 1410 through the first discharge portion 1441. By opening and closing the first discharge portion 1441, the door portion 1460 may allow the heat-exchanged air to flow toward at least one of the first discharge portion 1441 and the second discharge portion 1442.

Particularly, referring to FIG. 10, the door portion 1460 is provided such that the door blade 1461 rotates about a door rotational axis 1462 to open the first discharge portion 1441. Further, the first blowing fan 1489 moves the heat-exchanged air, which is sucked into the inside of the housing 1410 by the second blowing fan 1480 and heat-exchanged, to the first discharge portion 1441. The air sucked into the first discharge portion 1441 by the first blowing fan 1489 is discharged to the outside of the housing 1410 through the opening.

The second discharge portion 1442 is configured to discharge air through the middle panel 1412. When the air conditioner 1400 is in the second mode, the heat-exchanged air may be discharged to the outside of the housing 1410 through the second discharge portion 1442.

Particularly, referring to FIG. 11, as for the door portion 1460, the door blade 1461 may close the first discharge portion 1441 by rotating about the door rotational axis 1462, and the first blowing fan 1489 is not driven. Accordingly, air, which is introduced to the inside the housing 1410 by the second blowing fan 1480 and heat-exchanged, may be discharged through the second discharge portion 1442.

With this configuration, the air conditioner 1400 may discharge the heat-exchanged air to the outside while reducing a wind speed of the air. The second discharge portion 1442 may include a plurality of discharge holes formed to penetrate inner and outer surfaces of the discharge plate 1412*b*. According to an example, the second discharge portion 1442 may be provided in a front surface and a part of opposite side surfaces of the middle panel 1412.

When the heat-exchanged air is discharged to the outside of the housing 1410 through the second discharge portion 1442, air blown by the second blowing fan 1480 may flow through a second discharge flow path 1492 provided between the heat exchanger 1420 and the second discharge portion 1442.

Hereinafter, an air conditioner according to another embodiment will be described.

The description of the same configuration as those shown in the above description will be omitted.

FIG. 12 is a perspective view illustrating an air conditioner according to another embodiment, and FIG. 13 is an exploded-perspective view illustrating the air conditioner of FIG. 12. FIG. 14 is a view illustrating air discharged through a first discharge portion of the air conditioner of FIG. 12. FIG. 15 is a view illustrating the flow of air discharged from the first discharge portion in the air conditioner of FIG. 12. FIG. 16 is a view illustrating the flow of air discharged from a second discharge portion in the air conditioner of FIG. 12.

Referring to FIGS. 12 to 16, an indoor portion of an air conditioner 1500 includes a housing 1510 having at least one opening 1514 and forming an outer appearance thereof, a heat exchanger 1520 exchanging heat with air introduced into the inside of the housing 1510, a blowing portion 1580 and 1589 circulating air to the inside or outside of the housing 1510, and a discharge portion 1540 discharging air blown from the blowing portion 1580 and 1589 to the outside of the housing 1510.

The housing 1510 may include an upper panel 1511, a middle panel 1512 and a lower panel 1513. The middle panel 1512 may include a discharge panel 1512*b* in which a second discharge portion 1542 is disposed.

A first discharge portion 1541 described later may be provided inside of the upper panel 1511. That is, the first discharge portion 1541 may be inserted into the inside of the upper panel 1511 and thus the first discharge portion 1541 may be selectively not exposed to the outside.

The second discharge portion 1542 described later may be provided in the middle panel 1512. A suction portion 1519 may be provided in a front side and at least one side surface of the lower panel 1513. The position of the second discharge portion 1542 and the suction portion 1519 is not limited thereto.

The discharge portion 1540 may include the first discharge portion 1541 and the second discharge portion 1542. The heat-exchanged air may be discharged through at least one of the first discharge portion 1541 and the second discharge portion 1542. Further, the heat-exchanged air may be selectively discharged through any one of the first discharge portion 1541 and the second discharge portion 1542.

The first discharge portion 1541 is provided to allow the heat-exchanged air to be directly discharged to the outside. Through the opening 1514 disposed in the housing 1510, the first discharge portion 1541 may be pulled out to the outside of the housing 1510 or inserted into the inside of the housing 1510, and selectively exposed to the outside of the housing 1510.

Particularly, the first discharge portion 1541 may include a head 1544 in which a plurality of first discharge holes 1543 is disposed, and a head support 1546 in which a head driver 1545 configured to pull out the first discharge portion 1541 to the outside of the housing 1510 or insert the first discharge portion 1541 to the inside of the housing 1510, is provided.

A shape and size of the head 1544 may be provided to correspond to the shape and size of the opening 1514 of the housing 1510 so that the head 1544 is easily passed through the opening 1514. The head 1544 may include the first discharge hole 1543 disposed on a front surface and a part of a side surface thereof to discharge the heat-exchanged air. The first discharge hole 1543 may have a larger size than a plurality of discharge holes of the second discharge portion 1542, described later, so that air blown by the first blowing fan 1589 is discharged while maintaining a high wind speed.

The head support 1546 may include the head driver 1545 disposed in the lower portion of the head 1544 to drive the head 1544 in the vertical direction while supporting the head 1544. FIG. 13 illustrates that the head driver 1545 includes a rack gear and a pinion gear engaged with the rack gear to be connected to a driving source, which are disposed on a side surface of the head support 1546, and the head driver 1545 drives the head 1544 in the vertical direction through the rack and pinion structure. However, the head driver 1545 configured to drive the head 1544 in the vertical direction is not limited thereto, and thus any configuration may be applied as long as capable of driving the head 1544 in the vertical direction.

In addition, the head support 1546 may be coupled to a head guide 1515 disposed in the housing 1510 and thus the drive of the head support 1546 in the vertical direction may be guided. The head guide 1515 may be extended in the housing 1510 by a predetermined distance in the vertical direction of the housing 1510.

With this configuration, as illustrated in FIGS. 13 to 15, as for the air conditioner 1500 according to the embodiment, when the first discharge portion 1541 moves upward to be exposed to the outside of the housing 1510 and the first blowing fan 1589 is driven, the air conditioner 1500 may discharge air through the first discharge portion 1541, and when the first discharge portion 1541 moves downward to be inserted into the inside of the housing 1510 and the first blowing fan 1589 is not driven, the air conditioner 1500 may discharge air through the second discharge portion 1542.

The air blown by the first blowing fan 1589 may flow through the first discharge flow path 1591 disposed between the first blowing fan 1589 and the first discharge portion 1541. Particularly, the first blowing fan 1589 sucks air, which is introduced to the inside of the housing 1510 by a second blowing fan 1580, to an upper side of the housing 1510 in which the first discharge portion 1541 is provided, and then moves the air to the first discharge hole 1543. The first blowing fan 1589 may be disposed inside of the first discharge portion 1541. The first blowing fan 1589 may suck the air in the rotation axis direction and then discharge the air in the radial direction.

The second discharge portion 1542 is configured to discharge the air through the outer panel. When the air conditioner 1500 is in the second mode, the heat-exchanged air may be discharged to the outside of the housing 1510 through the second discharge portion 1542. That is, when the first discharge portion 1541 is inserted into the inside of the housing 1510 and the first blowing fan 1589 is not driven, the air may be sucked into the inside of the housing 1510 by the second blowing fan 1580 and heat-exchanged and then discharged to the outside of the housing 1510 through the second discharge portion 1542.

With this configuration, the air conditioner 1500 may discharge the heat-exchanged air to the outside while reducing a wind speed thereof. The second discharge portion 1542 may include a plurality of discharge holes formed to penetrate inner and outer surfaces of the discharge plate 1512*b*. According to an example, the second discharge portion 1542 may be provided on a front surface and one side surface of the middle panel 1512.

When the heat-exchanged air is discharged to the outside of the housing 1510 through the second discharge portion 1542, air blown by the second blowing fan 1580 may flow through a second discharge flow path 1592 provided between the heat exchanger 1520 and the second discharge portion 1542.

Hereinafter, an air conditioner according to another embodiment will be described.

The description of the same configuration as those shown in the above description will be omitted.

FIG. 17 is a perspective view illustrating an air conditioner according to another embodiment, and FIG. 18 is an exploded-perspective view illustrating the air conditioner of FIG. 17. FIG. 19 is a view illustrating the flow of air discharged through a first discharge portion of the air conditioner of FIG. 17. FIG. 20 is a view illustrating the flow of air discharged from a second discharge portion in the air conditioner of FIG. 17.

Referring to FIGS. 17 to 20, an indoor portion of an air conditioner 1600 includes a housing 1610 having at least one opening and forming an outer appearance thereof, a heat exchanger 1620 exchanging heat with air introduced into the inside of the housing 1610, a blowing portion 1680 and 1689 circulating air to the inside or outside of the housing 1610, and a discharge portion 1640 discharging air blown from the blowing portion 1680 and 1689 to the outside of the housing 1610.

The housing 1610 may include an upper panel 1611, a middle panel 1612 and a lower panel 1613. The lower panel 1613 may include a discharge panel 1613*b* in which a second discharge portion 1642 is disposed.

A first discharge portion 1641 described later may be provided in the upper panel 1611. The second discharge portion 1642 described later may be provided in the lower panel 1613. A suction portion 1619 may be provided in at least one side surface of the upper panel 1611. For example, the suction portion 1619 may be disposed on two side surfaces, which are adjacent to each other, of the upper panel 1611. However, the position of the first discharge portion 1641, the second discharge portion 1642 and the suction portion 1619 is not limited thereto.

The discharge portion 1640 may include the first discharge portion 1641 and the second discharge portion 1642. The heat-exchanged air may be discharged through at least one of the first discharge portion 1641 and the second discharge portion 1642. Further, the heat-exchanged air may be selectively discharged through any one of the first discharge portion 1641 and the second discharge portion 1642.

The first discharge portion 1641 is configured to allow air to be discharged through an opening formed in the housing 1610. The first discharge portion 1641 is provided to allow the heat-exchanged air to be directly discharged to the outside. The first discharge portion 1641 may be disposed on two side surfaces, which are adjacent to each other, of the upper panel 1611

The air blown by the first blowing fan 1689 may flow through a first discharge flow path 1691 disposed between the first blowing fan 1689 and the first discharge portion 1641. Particularly, the first blowing fan 1689 sucks air in the outside of the housing 1610 to the inside of the housing 1610, and then moves the air to the first discharge portion 1641. The first blowing fan 1689 may be disposed inside of the upper panel 1611.

A rear surface of the first blowing fan 1689 may face the suction portion 1619 and a front surface of the first blowing fan 1689 may face the first discharge portion 1641 so that the first blowing fan 1689 may blow air, which is sucked through the rear surface thereof, to the front surface thereof. That is, since the front surface of the first blowing fan 1689 is disposed to face the first discharge portion 1641, which is formed on two side surfaces of the upper panel 1611, which are adjacent to each other, the first blowing fan 1689 may move air, which is sucked through the suction portion 1619 provided on the rear surface thereof, to the first discharge portion 1641.

Particularly, referring to FIG. 19, when the second blowing fan 1680 is not driven, air, which is sucked by the first blowing fan 1689, may be heat-exchanged by passing through the heat exchanger 1620 and then discharged to the outside of the housing 1610 through the first discharge portion 1641.

The second discharge portion 1642 is configured to discharge the air through the lower panel 1613. When the air conditioner 1600 is in the second mode, the heat-exchanged air may be discharged to the outside of the housing 1610 through the second discharge portion 1642.

Particularly, referring to FIG. 20, when the second blowing fan 1680 is driven, air, which is sucked by the first blowing fan 1689, may be heat-exchanged by passing through the heat exchanger 1620 and then guided to the lower side of the housing 1610 by the second blowing fan 1680. The air guided to the lower side of the housing 1610 may be discharged to the outside of the housing 1610 through the second discharge portion 1642 while the wind speed thereof is reduced.

With this configuration, the air conditioner 1600 may discharge the heat-exchanged air to the outside while reducing a wind speed thereof. The second discharge portion 1642 may include a plurality of discharge holes formed to penetrate inner and outer surfaces of the discharge plate 1613*b*. According to an example, the second discharge portion 1642 may be provided on a front surface and a part of opposite side surfaces of the middle panel 1612.

When the heat-exchanged air is discharged to the outside of the housing 1610 through the second discharge portion 1642, air blown by the second blowing fan 1680 may flow through a second discharge flow path 1692 formed between the heat exchanger 1620 and the second discharge portion 1642.

While the present disclosure has been particularly described with reference to exemplary embodiments, it should be understood by those of skilled in the art that various changes in form and details may be made without departing from the spirit and scope of the present disclosure.

The invention claimed is:

1. An air conditioner comprising:

a housing provided with an outer panel forming an appearance, and an opening formed in the outer panel;

a heat exchanger configured to exchange heat with air introduced to the inside of the housing;

a first discharge portion connected to the opening to discharge the heat-exchanged air to the outside;

a second discharge portion disposed in a lower side of the first discharge portion in the outer panel to discharge the heat-exchanged air, the second discharge portion including an airflow controller to uniformly discharge heat-exchanged air to an entire area of the second discharge portion; and a blowing fan disposed inside of the housing and configured to move the air, which is heat-exchanged by the heat exchanger, in a direction of the second discharge portion.

2. The air conditioner of claim 1, wherein the heat-exchanged air is selectively discharged to any one of the first discharge portion and the second discharge portion.

3. The air conditioner of claim 1, wherein the blowing fan is disposed between the first discharge portion and the second discharge portion.

4. The air conditioner of claim 3, further comprising:

a door portion configured to open or close the first discharge portion, wherein the door portion allows an air flow of the heat-exchanged air to discharge at least one of the first discharge portion and the second discharge portion by opening or closing the first discharge portion.

5. The air conditioner of claim 1, wherein the second discharge portion comprises a plurality of discharge holes formed in the outer panel and formed to penetrate an inner and outer surface of the outer panel.

6. The air conditioner of claim 1, wherein the second discharge portion is formed extended along a front surface and at least one side surface of the outer panel.

7. The air conditioner of claim 1, wherein:

the housing comprises a suction portion formed in a first surface of an upper portion of the outer panel, and the first surface is aligned with a second side surface of the upper portion of the outer panel in which the first discharge portion is formed.

8. The air conditioner of claim 1, wherein the airflow controller is formed such that a front surface thereof is increasingly inclined to approach the second discharge portion as the front surface goes to a lower portion of the airflow controller.

9. The air conditioner of claim 1, wherein the airflow controller is disposed such that a front surface thereof faces the blowing fan.

10. An air conditioner comprising:

a housing provided with an outer panel forming an appearance, and an opening formed in the outer panel;

a heat exchanger configured to exchange heat with air introduced to the inside of the housing;

a first discharge portion connected to the opening to discharge the heat-exchanged air to the outside;

a second discharge portion formed in a lower side of the first discharge portion in the outer panel to discharge the heat-exchanged air, the second discharge portion including an airflow controller to uniformly discharge heat-exchanged air to an entire area of the second discharge portion;

a first discharge flow path configured to connect the heat exchanger to the first discharge portion; and a second discharge flow path configured to connect the heat exchanger to the second discharge portion.

11. The air conditioner of claim 10, further comprising:

a first blowing fan disposed in the first discharge flow path to move the air, which is heat-exchanged by the heat exchanger, to a direction of the first discharge portion.

12. The air conditioner of claim 11, wherein the first discharge portion selectively discharges the heat-exchanged air according to whether the first blowing fan is driven or not.

13. The air conditioner of claim 11, further comprising:

a second blowing fan disposed inside of the housing to suck air in the outside of the housing.

14. The air conditioner of claim 10, wherein:

the first discharge portion is selectively exposed to the outside of the housing, when the first discharge portion is pulled out to the outside of the housing, the heat-exchanged air is discharged through the first discharge portion, and when the first discharge portion is inserted into the inside of the housing, the heat-exchanged air is discharged through the second discharge portion.

15. The air conditioner of claim 10, wherein the second discharge portion is formed extended along a front surface and at least one side surface of the outer panel.

16. The air conditioner of claim 10, wherein:

the housing comprises a suction portion formed in a first surface of an upper portion of the outer panel, and the first surface is aligned with a second side surface of the upper portion of the outer panel in which the first discharge portion is formed.

17. The air conditioner of claim 10, wherein the airflow controller is formed such that a front surface thereof is increasingly inclined to approach the second discharge portion as the front surface goes to a lower portion of the airflow controller.

18. The air conditioner of claim 10, further comprising a first blowing fan and a second blowing fan, wherein the airflow controller is disposed such that a front surface thereof faces the second blowing fan.

* * * * *